US009156483B2

(12) United States Patent
Cooper et al.

(10) Patent No.: US 9,156,483 B2
(45) Date of Patent: Oct. 13, 2015

(54) SYSTEM AND METHOD FOR CHANGING WHEN A VEHICLE ENTERS A VEHICLE YARD

(71) Applicant: General Electric Company, Schenectady, NY (US)

(72) Inventors: Jared Klineman Cooper, Melbourne, FL (US); Robert Francis Bryant, Melbourne, FL (US); Mitchell Scott Wills, Melbourne, FL (US); James Knox, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 282 days.

(21) Appl. No.: 13/739,132

(22) Filed: Jan. 11, 2013

(65) Prior Publication Data

US 2013/0131909 A1 May 23, 2013

Related U.S. Application Data

(63) Continuation-in-part of application No. 13/288,391, filed on Nov. 3, 2011, now abandoned.

(51) Int. Cl.

| | |
|---|---|
| ***G05D 1/00*** | (2006.01) |
| ***B61L 27/00*** | (2006.01) |
| ***B61L 3/00*** | (2006.01) |
| ***B61L 17/00*** | (2006.01) |
| *B61L 15/00* | (2006.01) |

(52) U.S. Cl.

CPC ..... *B61L 27/0011* (2013.01); *B61L 3/006* (2013.01); *B61L 17/00* (2013.01); *B61L 27/0016* (2013.01); *B61L 27/0027* (2013.01); *B61L 15/0027* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,487,516 | A * | 1/1996 | Murata et al. | 246/182 C |
| 7,937,193 | B2 * | 5/2011 | Philp et al. | 701/19 |
| 8,676,410 | B2 * | 3/2014 | Houpt et al. | 701/19 |
| 2004/0133315 | A1 * | 7/2004 | Kumar et al. | 700/302 |
| 2004/0172175 | A1 * | 9/2004 | Julich et al. | 701/19 |
| 2006/0212184 | A1 * | 9/2006 | Philp et al. | 701/19 |
| 2007/0005200 | A1 * | 1/2007 | Wills et al. | 701/19 |
| 2007/0299570 | A1 * | 12/2007 | Muinonen et al. | 701/19 |
| 2008/0154692 | A1 * | 6/2008 | Logan et al. | 705/9 |
| 2008/0183345 | A1 * | 7/2008 | Chandra et al. | 701/19 |
| 2010/0043388 | A1 | 2/2010 | Mason | |
| 2010/0150705 | A1 | 6/2010 | Mason | |
| 2010/0163687 | A1 | 7/2010 | Brand | |
| 2010/0185472 | A1 | 7/2010 | Goodermuth | |
| 2010/0241295 | A1 | 9/2010 | Cooper | |
| 2011/0051663 | A1 | 3/2011 | Cooper | |
| 2011/0060486 | A1 | 3/2011 | Meltser | |
| 2011/0099413 | A1 | 4/2011 | Cooper | |
| 2013/0144670 | A1 * | 6/2013 | Kickbusch | 705/7.12 |
| 2015/0066561 | A1 * | 3/2015 | Wills et al. | 705/7.23 |

* cited by examiner

*Primary Examiner* — Jonathan L Sample

(74) *Attorney, Agent, or Firm* — GE Global Patent Operation

(57) ABSTRACT

A method includes, responsive to a determination that a first vehicle system to be received in a vehicle yard is longer than a length of a receiving route of the vehicle yard that is designated for receiving the first vehicle system, processing a first movement plan to generate a revised movement plan. The first movement plan governs movement of the first vehicle system and one or more second vehicle systems in a transportation network that includes the vehicle yard. The revised movement plan is generated based at least in part on a designated time restriction for the first vehicle system to travel to and be received within the vehicle yard on the receiving route. The method also includes controlling at least one of the first vehicle system or at least one of the one or more second vehicle systems based on the revised movement plan.

20 Claims, 9 Drawing Sheets

SYSTEM AND METHOD FOR CHANGING WHEN A VEHICLE ENTERS A VEHICLE YARD

CROSS-REFERENCE TO RELATED APPLICATIONS

This application is a continuation-in-part application of U.S. application Ser. No. 13/288,391, filed 3 Nov. 2011, and entitled "System And Method For Changing When A Vehicle Enters A Vehicle Yard," the entire disclosure of which is incorporated herein by reference.

BACKGROUND

A transportation network for vehicles can include several interconnected main routes on which separate vehicles travel between locations. For example, a transportation network may be formed from interconnected railroad tracks with rail vehicles traveling along the tracks. The vehicles may travel according to schedules that dictate where and when the vehicles are to travel in the transportation network. The schedules may be coordinated with each other in order to arrange for certain vehicles to arrive at various locations in the transportation network at desired times and/or in a desired order.

The transportation network can include a vehicle yard, such as a rail yard that includes a relatively dense grouping of routes or locations where several vehicles can congregate. As the vehicles travel through the transportation network, one or more vehicles may travel to a vehicle yard for storage, maintenance, refueling, reordering with other vehicles, and the like. The times at which the vehicles are to travel to and enter into the vehicle yards may be dictated by the schedules of the vehicles.

But, due to unforeseen circumstances, such as damage to routes in the transportation network, unplanned maintenance to one or more vehicles, accidents, and the like, one or more vehicles may fall behind their associated schedules. Falling behind the schedules can cause the vehicles to enter into and/or leave a vehicle yard at a different time than previously scheduled. As a result, the number of vehicles in a vehicle yard may vary from a previously scheduled or planned number.

The capacity of vehicle yards to receive vehicles may vary as the numbers of vehicles in the vehicle yards change. If a vehicle is scheduled to enter into a vehicle yard at a time when the vehicle yard has insufficient capacity to enter into the yard, the vehicle may need to stop outside of the vehicle yard and wait for the capacity to increase so that the vehicle can enter into the vehicle yard. For example, a train having one or more locomotives and several cars may be unable to fit into a rail yard when other locomotives, cars, or other vehicles are in the rail yard and there is not enough room to receive the additional locomotive and cars of the train. As a result, the vehicle waiting to enter the vehicle yard may waste resources such as time, fuel, and/or operator time, and/or generate additional emissions while waiting for the capacity of the vehicle yard to increase.

Some vehicles may be longer than a receiving route (e.g., track) of a vehicle yard. For example, some trains may be longer that the longest continuous track in a rail yard. When such a train arrives at the rail yard, the train may be required to stop to be divided up into smaller groupings of the rail cars and/or locomotives in the train. The smaller groupings can then be received into the rail yard.

Dividing up the vehicles, however, can take a significant amount of time. Additionally, operation of the vehicles may be subject to legal limitations, such as time limits on how long a crew of operators can continuously work before being replaced by a new crew of operators. Switching out the crew of operators can be a significant, and at times uncontrollable, expense in the operation of the vehicles. For example, a long train that arrives at a rail yard too late for an existing crew to separate the train into smaller groupings and enter the groupings into the rail yard may be subject to more expensive local crews of operators, with the local crews of operators having payment requirements that may not be able to be controlled or anticipated in advance.

BRIEF DESCRIPTION

In one embodiment, a method (e.g., for scheduling and/or controlling travel of a vehicle system in a transportation network) includes, responsive to a determination that a first vehicle system to be received in a vehicle yard is longer than a length of a receiving route of the vehicle yard that is designated for receiving the first vehicle system, processing a first movement plan to generate a revised movement plan.

As used herein, the term "vehicle yard" can refer to a grouping of interconnected routes, such as interconnected railroad tracks, that are disposed relatively close to each other and/or where several vehicles can concurrently stop for maintenance, refueling, re-ordering of the vehicles relative to each other, and the like. For example, a vehicle yard can include routes that are more densely packed relative to the density of the routes outside of the vehicle yard.

The first movement plan governs movement of the first vehicle system and one or more second vehicle systems in a transportation network that includes the vehicle yard. The revised movement plan is generated based at least in part on a designated time restriction for the first vehicle system to travel to and be received within the vehicle yard on the receiving route. The method also includes controlling at least one of the first vehicle system or at least one of the one or more second vehicle systems based on the revised movement plan.

In one embodiment, a system (e.g., a scheduling system) includes a monitoring module and a scheduling module. As used herein, the terms "module" or "unit" may include one or more hardware and/or software systems that operates to perform one or more functions. For example, a module or unit may include a computer processor, controller, or other logic-based device that performs operations based on instructions stored on a tangible and non-transitory computer readable storage medium, such as a computer memory. Alternatively, a module or unit may include a hard-wired device that performs operations based on hard-wired logic of the device. The modules and units shown in the attached figures may represent the hardware that operates based on software or hardwired instructions, the software that directs hardware to perform the operations, or a combination thereof.

The monitoring module is configured to determine when a length of a first vehicle system is longer than a length of a receiving route of the vehicle yard that is designated for receiving the first vehicle system. The scheduling module is configured to process a first movement plan to generate a revised movement plan in response to the monitoring module determining that the length of the first vehicle system is longer than the length of the receiving route. The first movement plan governs movement of the first vehicle system and one or more second vehicle systems in a transportation network that includes the vehicle yard. The scheduling module is configured to generate the revised movement plan based at least in part on a designated time restriction for the first vehicle system to travel to and be received within the vehicle yard on the receiving route.

In one embodiment, a method (e.g., for scheduling and/or controlling travel of a vehicle system) includes determining if a length of the vehicle system that includes one or more vehicles interconnected with each other exceeds a space limitation of a vehicle yard that is scheduled to receive the vehicle system and calculating a travel time for the vehicle system to travel from at least one of a current or initial location to the vehicle yard, for the vehicle system to be separated into plural separate vehicle subsystems, and for the separate vehicle subsystems to be received into the vehicle yard. The method also includes, responsive to determining when the travel time exceeds a designated working time restriction on how long one or more operators of the vehicle system can work on the vehicle system before being replaced by one or more other operators, modifying a schedule of the vehicle system such that the vehicle system arrives at the vehicle yard at least a designated time period before expiration of the designated working time restriction after the vehicle system begins traveling toward the vehicle yard.

In one embodiment, a system includes a control unit that is configured to be disposed on-board a first vehicle that moves along a route of a transportation network having a vehicle yard.

The control unit also is configured to receive, from off-board the first vehicle, an updated time of entry into the vehicle yard for the approaching vehicle and to change a speed of the first vehicle in response to the updated time of entry.

In another embodiment, a method includes receiving an updated time of entry into a vehicle yard at a first vehicle that is moving along a route of a transportation network that includes the vehicle yard and changing a speed of the first vehicle in response to the updated time of entry. The updated time is received from off-board the first vehicle.

In another embodiment, another system includes a monitoring module and a scheduling module. The monitoring module is configured to track a capacity of a vehicle yard in a transportation network to receive vehicles for layover in the vehicle yard over time. The scheduling module is configured to determine an updated time of entry for a first vehicle to enter the vehicle yard based on the capacity of the vehicle yard at the updated time of entry. The scheduling module is configured to communicate the updated time of entry to the first vehicle so that the first vehicle can change speed as the first vehicle moves toward the vehicle yard.

In another embodiment, another method includes tracking a capacity of a vehicle yard to receive vehicles over time, determining an updated time of entry for a first vehicle to enter the vehicle yard based on the capacity of the vehicle yard at the updated time of entry, and communicating the updated time of entry to the first vehicle so that the first vehicle can change speed as the first vehicle moves toward the vehicle yard.

In another embodiment, another system includes a monitoring module and a scheduling module. The monitoring module is configured to track a capacity of a vehicle yard to receive plural vehicles for layover in the vehicle yard over time. The vehicle yard is part of a transportation network having plural routes over which the plural vehicles may travel. The monitoring module is further configured to monitor movement of a first vehicle and at least one second vehicle of the plural vehicles in the transportation network. The scheduling module is configured to determine an updated time of entry for the first vehicle to enter the vehicle yard based on the capacity of the vehicle yard at the updated time of entry. The scheduling module is further configured to designate one or more scheduled waypoints between a current location of the first vehicle and the vehicle yard based on the updated time of entry and the movement of the first and second vehicles. Each of the one or more scheduled waypoints being defined by a location of the waypoint and a scheduled time of arrival of the first vehicle at the waypoint. The one or more scheduled waypoints are designated such that movement of the first vehicle to arrive at the one or more scheduled waypoints as scheduled and enter the vehicle yard at the updated time of entry meets one or more criteria in regards to movement of the at least one second vehicle. The scheduling module also is configured to communicate the updated time of entry and the one or more scheduled waypoints to the first vehicle for the first vehicle to change its speed to meet the scheduled waypoints and updated time of entry.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
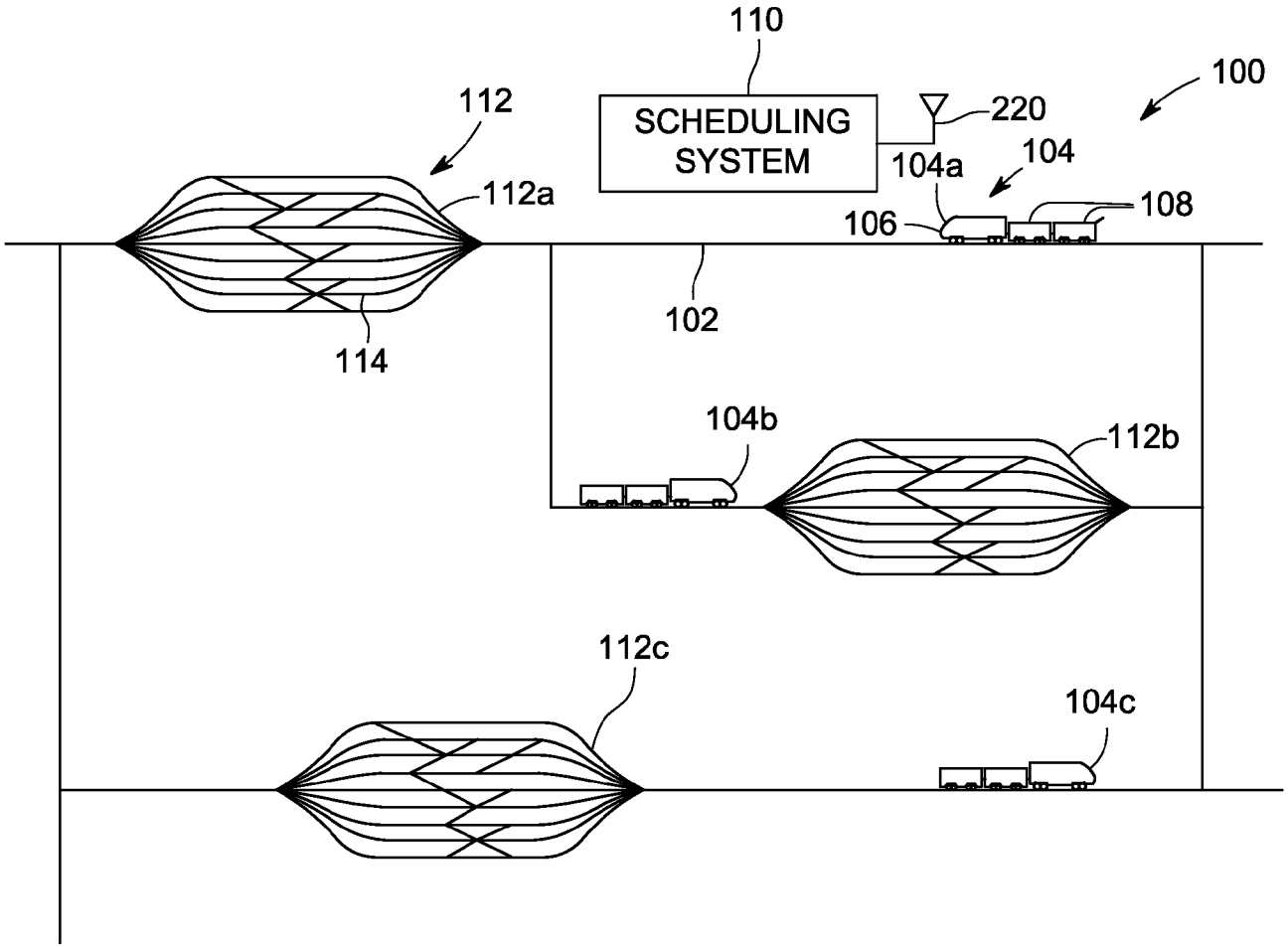
FIG. 1 is a schematic diagram of one embodiment of a transportation network.

One or more embodiments of the inventive subject matter described herein provide systems for coordinating arrival of a vehicle system moving toward a vehicle yard with a capacity of the vehicle yard to receive the vehicle system. The vehicle system may travel to the vehicle yard to be stored at the vehicle yard (e.g., to end a current trip of the vehicle system and remain at the vehicle yard), for repair and/or maintenance of the vehicle system, to obtain additional fuel, to unload cargo and/or cars off of the vehicle system, to load cargo and/or cars onto the vehicle system, to sort the vehicle system among other vehicle systems (e.g., to rearrange an order of the vehicle systems such that the vehicle systems leave the vehicle yard in a designated order), or the like. The vehicle yard may act as a transportation hub in a transportation network, such as when the vehicle yard is coupled with several routes extending away from the vehicle yard for the vehicle systems to travel along to reach other destinations. The vehicle yard may be a final destination of a trip of the vehicle system, or may be an intermediate stopping off point when the vehicle system is traveling to another business destination (e.g., the destination to which the vehicle system is contracted to travel).

The vehicle yard may have a capacity to receive vehicle systems into the vehicle yard. This capacity can be a space limitation on the number of vehicle systems that can exit off of a main line route into the vehicle yard. As vehicle systems come and go from the vehicle yard, the capacity of the vehicle yard to accept other vehicle systems changes. Additionally, the vehicle yard may be associated with an upper space limitation, such as an upper limit on a receiving route of the vehicle yard. This upper limit can represent a limitation on the length of vehicle systems that can be received on a route at the vehicle yard. The upper space limitation may represent a length representative of the longest receiving route in the vehicle yard that can receive a vehicle system. The upper limit may represent the largest length of continuous route (e.g., track) in the yard such that a single vehicle system that is no longer than the upper limit can be disposed on the largest length of continuous route without breaking up the vehicle system into smaller pieces and/or without one or more portions of the vehicle system being disposed on another route within the vehicle yard. This upper space limitation may be a limitation that is not based on how many other vehicle systems are in a vehicle yard at a particular time. For example, the vehicle yard may be defined by the upper space limitation, regardless of how many other vehicle systems are in the vehicle yard at a given time. Alternatively, the upper space limitation may represent an upper limit on the actual available space in the vehicle yard at a particular time. For example, the upper space limitation may change over time as other vehicle systems enter and/or leave the vehicle yard.

The travel of a vehicle system to the vehicle yard can be controlled such that the vehicle system arrives at the vehicle yard when the vehicle yard has sufficient capacity (e.g., space) to receive the vehicle system. In one embodiment, the vehicle system may be instructed to slow down as the vehicle system is traveling toward the vehicle yard so that the vehicle system does not arrive at the vehicle yard before the vehicle yard has sufficient capacity to receive the vehicle system. The vehicle system may be instructed to slow down when doing so does not have a significantly negative impact (e.g., the impact is below a designated threshold) on the flow of traffic in a transportation network formed from interconnected routes, including the route on which the vehicle system travels toward the vehicle yard.

Additionally or alternatively, the travel of a vehicle system to the vehicle yard can be controlled such that the vehicle system arrives at the vehicle yard with sufficient time to allow the vehicle system to be separated (e.g., broken up) into subsystems and received into the vehicle yard before expiration of a designated time limit. Some laws, regulations, and/or rules that govern travel of the vehicle systems to, within, and/or from the vehicle yard may limit the amount of time that the vehicle systems may be in operation by a crew of one or more human operators. For example, a "12-hour law" may not allow for one or more operators of a vehicle system to work on (e.g., operate) a vehicle system for more than twelve continuous hours. These laws, regulations, and/or rules may be referred to as time restrictions on travel of the vehicle systems. Violation of such time restrictions (e.g., where a vehicle system is operated for longer than the time restriction in order to travel to and be received in the vehicle yard, whether as a continuous vehicle system or as broken up into separate vehicle subsystems) can require a different crew of operators to take the place of a previous crew of operators and/or payment of additional labor costs (e.g., overtime) upon reaching the time restriction.

In order to prevent violation of a working time restriction, the travel of a first vehicle system and/or one or more other vehicle systems within the transportation network may be controlled such that the first vehicle system arrives at the vehicle yard with sufficient time for the vehicle system to be divided (e.g., separated or broken) into separate subsystems and received into the vehicle yard prior to expiration of the working time restriction. For example, if a working time restriction does not allow for an operating crew to work for more than twelve continuous hours, the schedule of a vehicle system being operated by the operating crew may be created and/or modified such that the vehicle system leaves a starting location, travels to the vehicle yard, is broken up into smaller vehicle subsystems, and is received in the vehicle yard (e.g, as the smaller vehicle subsystems) within a time period that is no longer than the working time restriction.

While the discussion and figures included herein focus on rail yards as vehicle yards and rail vehicle consists (e.g., trains) as the vehicle systems, not all embodiments of the inventive subject matter described and claimed herein are limited to rail yards, trains, and railroad tracks. (A consist or vehicle system is a group of vehicles that are mechanically linked to travel together.) The inventive subject matter may apply to other vehicle systems, such as airplanes, ships, or automobiles. For example, one or more embodiments may apply to control when an airplane arrives at an airport, a shipping facility (e.g., where the airplane drops off and/or receives cargo for delivery elsewhere), a repair or maintenance facility, and the like. Other embodiments may apply to control when a ship arrives at a ship yard or dock, when an automobile arrives at a repair facility, a location having a high density of traffic (e.g., a heavily attended event with several automobiles parked at the event), at a shipping facility (e.g., where the automobile picks up and/or drops off cargo to be delivered elsewhere), and the like.

FIG. 1 is a schematic diagram of one embodiment of a transportation network 100. The transportation network 100 includes a plurality of interconnected routes 102, such as railroad tracks, roads, or other paths across which vehicle systems travel. The routes 102 may be referred to as main line routes when the routes 102 provide paths for the vehicle systems to travel along in order to travel between a starting location and a destination location (and/or to one or more intermediate locations between the starting location and the destination location). The transportation network 100 may extend over a relatively large area, such as hundreds of square miles or kilometers of land area. While only one transportation network 100 is shown in FIG. 1, one or more other transportation networks 100 may be joined with and accessible to vehicle systems traveling in the illustrated transportation network 100. For example, one or more of the routes 102 may extend to another transportation network 100 such that vehicle systems can travel between the transportation networks 100. Different transportation networks 100 may be defined by different geographic boundaries, such as different towns, cities, counties, states, groups of states, countries, continents, and the like. The number of routes 102 shown in FIG. 1 is meant to be illustrative and not limiting on embodiments of the described subject matter. Moreover, while one or more embodiments described herein relate to a transportation network formed from railroad tracks, not all embodiments are so limited. One or more embodiments may relate to transportation networks in which vehicle systems other than rail vehicle systems travel, such as paths taken by airplanes, roads or highways traveled by automobiles, water-borne shipping paths taken by ships, and the like.

Several vehicle systems 104 travel along the routes 102 in the transportation network 100. The vehicle systems 104 may concurrently travel in the transportation network 100 along the same or different routes 102. Travel of one or more vehicle systems 104 may be constrained to travel within the transportation network 100 (referred to herein as "intra-network travel"). Alternatively, one or more of the vehicle systems 104 may enter the transportation network 100 from another transportation network or leave the transportation network 100 to travel into another transportation network (referred to herein as "inter-network travel"). In the illustrated embodiment, the vehicle systems 104 are shown and described herein as rail vehicle systems or rail vehicle consists. However, one or more other embodiments may relate to vehicle systems other than rail vehicle systems or rail vehicle consists. While three vehicle systems 104 (e.g., systems 104*a*, 104*b*, 104*c*) are shown in FIG. 1, alternatively, a different number of vehicle systems 104 may be concurrently traveling in the transportation network 100.

A vehicle system 104 may include a group of powered units 106 (e.g., locomotives or other vehicle systems capable of self-propulsion) and/or non-powered units 108 (e.g., cargo cars, passenger cars, or other vehicle systems incapable of self-propulsion) that are mechanically coupled or linked together to travel along the routes 102, i.e., a consist. The powered units 106 may be referred to as propulsion-generating vehicles and the non-powered units 108 may be referred to as non-propulsion generating vehicles. The non-powered units 108 may be powered to perform work and/or provide one or more functions other than propelling the units 108. The routes 102 are interconnected to permit the vehicle systems 104 to travel over various combinations of the routes 102 to move from a starting location to a destination location.

In one embodiment, the vehicle systems 104 travel along the routes 102 according to a movement plan of the transportation network 100. The movement plan coordinates movement of the vehicle systems 104 in the transportation network 100 and can include schedules for the vehicle systems 104. For example, the movement plan may include schedules for the vehicle systems 104 to move from one or more different starting locations or current locations to one or more different destination locations. The schedules may dictate the destination location and a scheduled arrival time for a vehicle system 104 to reach the destination location.

The movement plan may be determined by a scheduling system 110. As shown in FIG. 1, the scheduling system 110 can be disposed off-board (e.g., outside) of the vehicle systems 104. For example, the scheduling system 110 may be disposed at a central dispatch office for a railroad company. The scheduling system 110 can create and communicate the schedules to the vehicle systems 104. The scheduling system 110 can include a communication unit (e.g., a wireless antenna 206 and associated transceiver equipment, such as a radio frequency (RF) or cellular antenna, and/or one or more wired communication connections) that communicate the schedules to the vehicle systems 104. For example, the scheduling system 110 may transmit destination locations and associated arrival times to the vehicle systems 104.

The vehicle systems 104 include control systems 206 (shown in FIG. 2) disposed on-board the vehicle systems 104. The control systems 206 receive the schedules from the scheduling system 110 and generate control signals that may be used to control propulsion of the vehicle systems 104 through the transportation network 100. For example, the vehicle systems 104 may include wireless antennas (and associated transceiver equipment), such as RF or cellular antennas, that receive the schedules from the scheduling system 110. The control systems on the vehicle systems 104 examine the schedules, such as by determining the scheduled destination location and scheduled arrival time for the respective vehicle system 104, and generate control signals based on the schedule. The control signals may be used to automatically control tractive efforts and/or braking efforts of the vehicle system 104 such that the vehicle system 104 self-propels along the routes 102 to the destination location. For example, the control system of a vehicle system 104 may be operatively coupled with a propulsion subsystem 216 (shown in FIG. 2) of the vehicle system 104. The propulsion subsystem may include motors (such as traction motors), engines, brakes (such as air brakes and/or regenerative brakes), and the like, that generate tractive energy to propel the vehicle system 104 and/or slow movement of the vehicle system 104. The control signals may automatically control the propulsion subsystem, such as by automatically changing throttle settings and/or brake settings of the propulsion subsystem. Additionally or alternatively, the control signals may be used to prompt an operator of the vehicle system 104 to manually control the tractive efforts and/or braking efforts of the vehicle system 104. For example, the control system may include an output device, such as a computer monitor, touchscreen, acoustic speaker, or the like, that generates visual and/or audible instructions based on the control signals. The instructions may direct the operator to manually change throttle settings and/or brake settings of the propulsion subsystem.

The control system 206 of a vehicle system 104 may form a trip plan for a trip of the vehicle system 104 to travel to a scheduled destination location at a scheduled arrival time. Optionally, the trip plan may be created off-board of the vehicle system 104 and communicated to the vehicle system 104. The trip plan may include throttle settings, brake settings, designated speeds, or the like, of the vehicle system 104 for various sections of the trip of the vehicle system 104. For example, the trip plan can include one or more velocity curves that designate various speeds of the vehicle system 104 along various sections of the routes 102. The trip plan can be formed based on a trip profile associated with an upcoming trip of a vehicle system 104. The trip profile can include information related to the vehicle system 104, the routes 102 over which the vehicle system 104 will traverse during the upcoming trip, and/or other information. The information related to the vehicle system 104 can include the type of vehicle system 104, the tractive energy generated by powered units 106 in the vehicle system 104, the weight or mass of the vehicle system 104 and/or cargo being carried by the vehicle system 104, the length and/or other size of the vehicle system 104 (e.g., how many powered and non-powered units 106, 108 are mechanically coupled with each other in the vehicle system 104), and the like. The information related to the route 102 can include the curvature, grade (e.g., inclination), existence of ongoing repairs, speed limits, and the like, for one or more sections of the route 102. The other information can include information related to conditions that impact how much fuel the vehicle systems 104 consume while traveling, such as the air pressure, temperature, humidity, and the like. The control system of a vehicle system 104 may form the control signals to control tractive efforts and/or braking efforts of the vehicle system 104 based on the trip plan.

In one embodiment, the trip plan is formed by the control system 206 (shown in FIG. 2) of the vehicle system 104 to reduce an amount of fuel that is consumed by the vehicle system 104 and/or an amount of emissions generated by the vehicle system 104 as the vehicle system 104 travels to a destination location associated with a schedule that is received by the vehicle system 104. The control system may create a trip plan having throttle settings, brake settings, designated speeds, or the like, that propels the vehicle system 104 to the scheduled destination location in a manner that consumes less fuel than if the vehicle system 104 traveled to the scheduled destination location in another manner. As one example, the vehicle system 104 may consume less fuel in traveling to the destination location according to the trip plan than if the vehicle system 104 traveled along the same routes to the destination location while traveling at another predetermined speed, such as the maximum allowable speed of the routes 102 (which may be referred to as "track speed") and/or if the vehicle system 104 was manually controlled.

The transportation network 100 includes one or more vehicle yards 112 (e.g., vehicle yards 112*a*, 112*b*, 112*c*). While three vehicle yards 112 are shown, alternatively, the transportation network 100 may include a different number of vehicle yards 112. The vehicle yards 112 include several interconnected routes 206 that are located relatively close to each other. For example, the routes 206 in the vehicle yards 112 may be closer together (e.g., less than 10, 20, or 30 feet or meters between nearby routes 206) than the routes 102 outside of the vehicle yards 112 (e.g., more than several miles or kilometers between nearby routes 102). The vehicle yards 112 are located along the routes 102 in order to provide services to the vehicle systems 104, such as to repair or maintain the vehicle systems 104, re-order the sequence of vehicle systems 104 traveling along the routes 102 from the vehicle yard 112, store one or more vehicle systems 104, load the vehicle systems 104 with additional cargo, unload cargo from the vehicle systems 104, add powered and/or non-powered units 106, 108 to the vehicle systems 104, remove powered and/or non-powered units 106, 108 to the vehicle systems 104, and the like. In one embodiment, the vehicle yards 112 are not used as routes to travel from a starting location to a destination location. For example, the vehicle yards 112 may not be main line routes along which the vehicle systems 104 travel from a starting location to a destination location. Instead, the vehicle yards 112 may be connected with the routes 102 to allow the vehicle systems 104 to get off of the main line routes 102 for services described above.

The vehicle yards 112 may have a capacity to receive the vehicle systems 104 into the vehicle yards 112. The capacity may represent an amount of available space on one or more of the routes 114 in the vehicle yards 112 for the vehicle systems 104 to be positioned, stored, repaired, and the like (e.g., to stop and remain in place). As vehicle systems 104 enter into and exit from the vehicle yards 112, the capacity of the vehicle yards 112 to receive other vehicle systems 104 into the vehicle yards 112 may change. As a result, the capacity of the vehicle yards 112 may be a time-variant parameter that can change as time passes. For example, with respect to trains as vehicle systems, the capacity of a vehicle yard 112 may change as different sized trains enter and/or leave the vehicle yard 112, and/or are built (e.g., put together to form a train) over time. The trains may be different sizes in that the trains may include different numbers and/or lengths of locomotives and/or other non-powered (e.g., incapable of self-propulsion) cars, such as rail cars that carry cargo and/or passengers. In one embodiment, the size of the vehicle system may predominantly be formed from non-powered vehicle systems, such as rail cars. In another aspect, size may be total length of a train or other rail vehicle consist.

The vehicle yards 112 may have upper space limitations to receive the vehicle systems 104 into the vehicle yards 112. As described above, the upper space limitations may represent upper limits on the length of receiving routes in the vehicle yards 112. For example, the upper space limitation for a vehicle yard 112 may represent the longest route in the vehicle yard 112 that can receive a vehicle system. In one embodiment, the upper space limitation of a vehicle yard 112 may be a static limitation that does not change with respect to time. Such a static space limitation can represent the longest (or other) length of receiving route in a vehicle yard 112. Additionally or alternatively, the upper space limitation of the vehicle yard 112 may be a dynamic limitation that can change with respect to time. For example, a dynamic space limitation may be the longest length of route in a vehicle yard 112 that is currently available to receive a vehicle system and/or that is anticipated or estimated to be available at a future time.

In one embodiment, the control systems 206 (shown in FIG. 2) of the vehicle systems 104 generate the trip plans. For example, one or more of the control systems 206 may create or modify trip plans to reduce an amount of fuel consumed and/or emissions generated by the vehicle systems 104. The control systems also may create and/or modify the trip plans to account for the capacity of a vehicle yard 112 to receive the vehicle systems 104 at a time when the vehicle systems 104 will arrive at the vehicle yard 112. For example, a control system may modify a trip plan of a vehicle system 104 to cause the vehicle system 104 to arrive at a vehicle yard 112 later than previously scheduled so that the vehicle system 104 arrives at the vehicle yard 112 when the vehicle yard 112 has capacity to receive the vehicle system 104. Otherwise, the vehicle system 104 may travel to the vehicle yard 112 according to the trip plan and be forced to sit and idle outside of the vehicle yard 112 until sufficient space becomes available in the vehicle yard 112 for the vehicle system 104 to be accepted. Such sitting and idling can cause the amount of fuel that is saved by traveling according to the trip plan to be consumed without propelling the vehicle system 104 and may be a wasted asset. The trip plan may be created based on the movement plan from the scheduling system 110. For example, the trip plan may be created to cause a vehicle system 104 to arrive at one or more locations (e.g., a rail yard 112) at a time designated by the movement plan, while consuming less fuel and/or generating fewer emissions relative to traveling according to the movement plan according to another plan (e.g., manual control that differs from the trip plan).

A control system 206 also may create and/or modify the trip plans to account for the time needed to break up the vehicle system 104 into smaller subsystems that fit within the vehicle yard 112. As described above, the scheduling system 110 can create a movement plan that directs the vehicle system 104 to arrive at a vehicle yard with sufficient time to break up the vehicle system into smaller vehicle subsystems that are smaller than the space limitation of the vehicle yard 112. If, however, the vehicle yard 112 does not have space available that is as large as the space limitation of the vehicle yard 112 (e.g., the longest track in a rail yard is not available at the scheduled time of arrival of the vehicle system 104), then the control system 206 may automatically (or upon manual confirmation or input) modify a previously trip plan to cause the vehicle system 104 to arrive at another time. For example, if a first trip plan is created to cause the vehicle system 104 to arrive in the yard 112 at a first time, the trip plan may be modified into a modified second trip plan that causes the vehicle system 104 to arrive when the vehicle yard 112 has space available that is as large as (or at least as large as) the space limitation. The vehicle yard 112 may then receive the vehicle system 104 (which may be as long as the space limitation of the vehicle yard 112).

Figure 2:
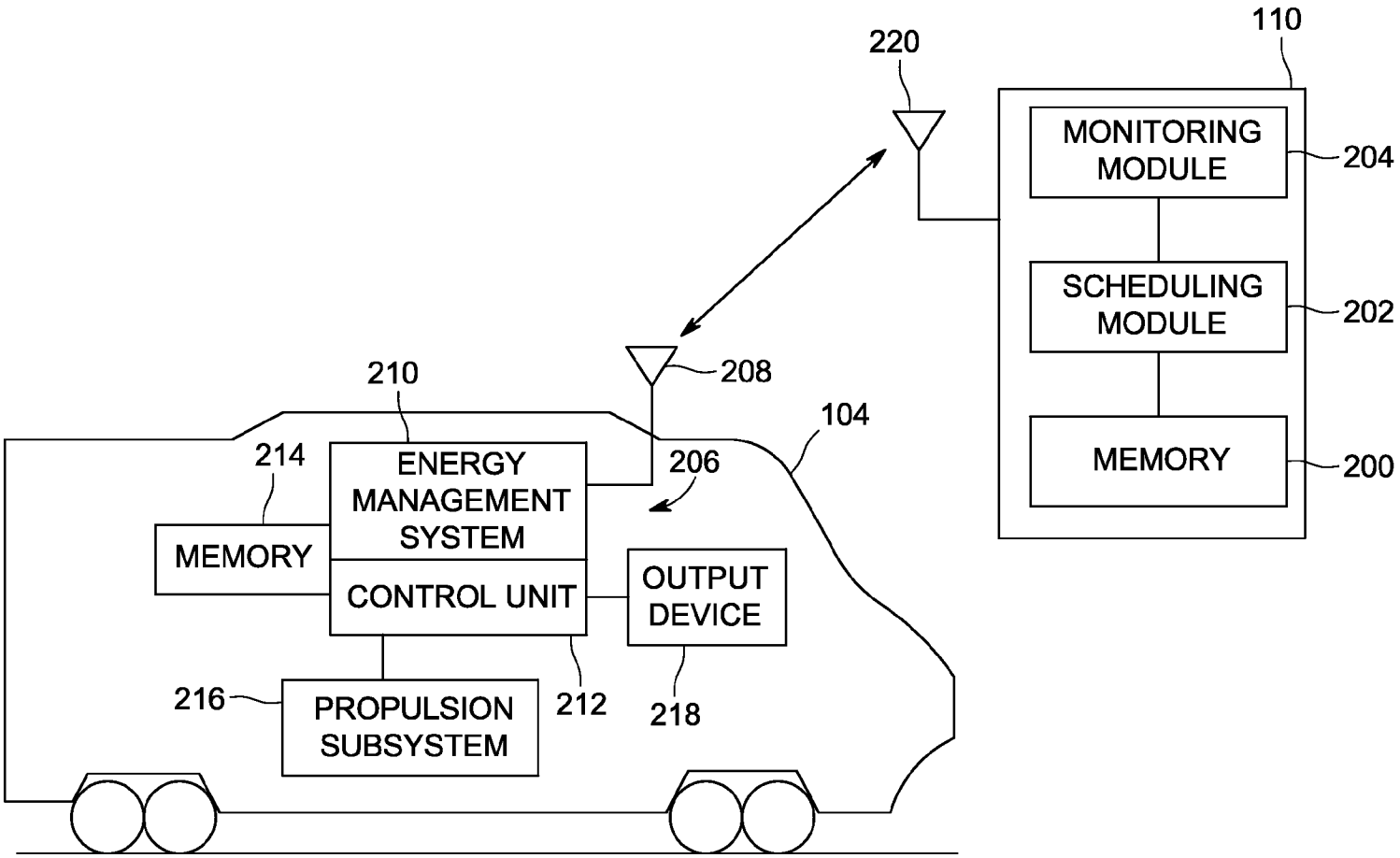
FIG. 2 is a schematic diagram of one embodiment of the scheduling system and a vehicle shown in FIG. 1.

FIG. 2 is a schematic diagram of one embodiment of the scheduling system 110 and the vehicle system 104. While the scheduling system 110 is shown in FIG. 2 as communicating with a single vehicle system 104, in one embodiment, the scheduling system 110 can concurrently communicate with two or more vehicle systems 104.

The scheduling system 110 includes several modules that perform various operations or functions described herein. The modules may include hardware and/or software systems that operate to perform one or more functions, such as one or more computer processors and/or one or more sets of instructions. The modules shown in FIG. 2 may represent the hardware (e.g., a computer processor) and/or software (e.g., one or more sets of instructions such as software applications or hard-wired logic) used to perform the functions or operations associated with the modules. A single hardware component (e.g., a single processor) and/or software component may perform the operations or functions of several modules, or multiple hardware components and/or software components may separately perform the operations or functions associated with different modules. The hardware and/or software components may be located in a single location (e.g., onboard or off-board a vehicle) or distributed among two or more locations (e.g., multiple onboard locations, off-board locations, and/or a combination of onboard and off-board locations). The instructions on which the hardware components operate may be stored on a tangible and non-transitory (e.g., not a transient signal) computer readable storage medium, such as a memory 200. The memory 200 may include one or more computer hard drives, flash drives, RAM, ROM, EEPROM, and the like. Alternatively, one or more of the sets of instructions that direct operations of the hardware components may be hard-wired into the logic of the hardware components, such as by being hard-wired logic formed in the hardware of a processor or controller.

The scheduling system 110 includes a scheduling module 202 that creates schedules (e.g., a movement plan) for the vehicle systems 104. In one embodiment, the scheduling module 202 controls communication between the scheduling system 110 and the vehicle systems 104. For example, the scheduling module 202 may be operatively coupled with the antenna 206 to permit the scheduling module 202 to control transmission or broadcast of data (e.g., schedules) to the vehicle systems 104 and to receive data (e.g., trip plans, sizes of the vehicle systems 104, locations of the vehicle systems 104, and the like) from the vehicle systems 104. Alternatively, another module or the processor may be operatively coupled with a communication unit 220 (e.g., a wireless antenna and associated transceiver circuitry and/or other hardware, and/or one or more wired connections) to control communication with the vehicle systems 104.

The scheduling module 202 creates schedules for the vehicle systems 104. The scheduling module 202 can form the movement plan for the transportation network 100 (shown in FIG. 1) that coordinates the schedules of the various vehicle systems 104 traveling in the transportation network 100. For example, the scheduling module 202 may generate schedules for the vehicle systems 104 that are based (at least in part) on capacities of the vehicle yards 112 (shown in FIG. 1) to receive the vehicle systems 104 when the vehicle systems 104 will arrive at the vehicle yards 112 and/or upper space limitations of the vehicle yards 112. The scheduling module 202 may delay a scheduled arrival time for a vehicle system 104 to arrive at a vehicle yard 112 if doing so does not have a significant negative impact on the flow of traffic in the transportation network 100. For example, the scheduling module 202 may delay an arrival time of a vehicle system 104 when delaying the arrival time does not decrease a throughput parameter of the transportation network 100 below a predetermined threshold.

The throughput parameter can represent the flow or movement of the vehicle systems 104 through the transportation network 100 or a subset of the transportation network 100. In one embodiment, the throughput parameter can indicate how successful the vehicle systems 104 are in traveling according to the schedule associated with each vehicle system 104. For example, the throughput parameter can be a statistical measure of adherence by one or more of the vehicle systems 104 to the schedules of the vehicle systems 104 in the movement plan. The term "statistical measure of adherence" can refer to a quantity that is calculated for a vehicle system 104 and that indicates how closely the vehicle system 104 is following the schedule associated with the vehicle system 104. Several statistical measures of adherence to the movement plan may be calculated for the vehicle systems 104 traveling in the transportation network 100.

In one embodiment, larger throughput parameters represent greater flow of the vehicle systems 104 through the transportation network 100, such as what may occur when a relatively large percentage of the vehicle systems 104 adhere to the associated schedules and/or the amount of congestion in the transportation network 100 are relatively low. Conversely, smaller throughput parameters may represent reduced flow of the vehicle systems 104 through the transportation network 100. The throughput parameter may reduce in value when a lower percentage of the vehicle systems 104 follow the associated schedules and/or the amount of congestion in the transportation network 100 is relatively large. Examples of how the throughput parameter may be calculated are described below.

The scheduling system 110 includes a monitoring module 204 in the illustrated embodiment. The monitoring module 204 can monitor travel of the vehicle systems 104 in the transportation network 100 (shown in FIG. 1) and/or capacities of the vehicle yards 112 (shown in FIG. 1) over time. The vehicle systems 104 may periodically report current positions of the vehicle systems 104 to the scheduling system 110 (and/or other information such as route and speed) so that the monitoring module 204 can track where the vehicle systems 104 are located. Alternatively, signals or other sensors disposed alongside the routes 102 (shown in FIG. 1) of the transportation network 100 can periodically report the passing of vehicle systems 104 by the signals or sensors to the scheduling system 110. The monitoring module 204 receives the locations of the vehicle systems 104 in order to monitor where the vehicle systems 104 are in the transportation network 100 over time.

The monitoring module 204 may track the capacities of the vehicle yards 112 (shown in FIG. 1) by monitoring how many vehicle systems 104 enter and how many vehicle systems 104 leave each of the vehicle yards 112. For example, if a vehicle yard 112 has a capacity to receive a predetermined length of vehicle systems, the monitoring module 204 may calculate a length of vehicle systems 104 currently in the vehicle yard 112 by tracking the total length of vehicle systems 104 that enter into the vehicle yard 112 and subtracting the total length of vehicle systems 104 that leave the vehicle yard 112. The difference between the total length of vehicle systems 104 that the vehicle yard 112 can accept when the vehicle yard 112 is empty and the total length of vehicle systems 104 currently in the vehicle yard 112 may be the current capacity of the vehicle yard 112 to accept more vehicle systems 104. In the case of a rail yard, the current capacity may also be a function of the number and respective lengths of the receiving tracks in the rail yard. For example, even if a receiving track is only partially full, it may be deemed as completely full for purposes of not being able to receive a consist that is longer than the free space remaining on the receiving track.

The monitoring module 204 may determine the throughput parameters of the transportation network 100 (shown in FIG. 1) and/or areas of the transportation network 100 that are used by the scheduling module 202. The monitoring module 204 can calculate the throughput parameters based on the schedules of the vehicle systems 104 and deviations from the schedules by the vehicle systems 104. For example, in order to determine a statistical measure of adherence to the schedule associated with a vehicle system 104, the monitoring module 204 may monitor how closely the vehicle system 104 adheres to the schedule as the vehicle system 104 travels in the transportation network 100 (shown in FIG. 1). The vehicle system 104 may adhere to the schedule of the vehicle system 104 by proceeding along a path toward the scheduled destination such that the vehicle system 104 will arrive at the scheduled destination at the scheduled arrival time. For example, an estimated time of arrival (ETA) of the vehicle system 104 may be calculated as the time that the vehicle system 104 will arrive at the scheduled destination if no additional anomalies occur that change the speed at which the vehicle system 104 travels. If the ETA is the same as or within a predetermined time window of the scheduled arrival time, then the monitoring module 204 may calculate a large statistical measure of adherence for the vehicle system 104. As the ETA differs from the scheduled arrival time (e.g., by occurring after the scheduled arrival time), the statistical measure of adherence may decrease.

Alternatively, the vehicle system 104 may adhere to the schedule by arriving at or passing through scheduled waypoints of the schedule at scheduled times that are associated with the waypoints, or within a predetermined time buffer of the scheduled times. As differences between actual times that the vehicle system 104 arrives at or passes through the scheduled waypoints and the associated scheduled times of the waypoints increases, the statistical measure of adherence for the vehicle system 104 may decrease. Conversely, as these differences decrease, the statistical measure of adherence may increase.

The monitoring module 204 may calculate the statistical measure of adherence as a time difference between the ETA of a vehicle system 104 and the scheduled arrival time of the schedule associated with the vehicle system 104. Alternatively, the statistical measure of adherence for the vehicle system 104 may be a fraction or percentage of the scheduled arrival time. For example, the statistical measure of adherence may be the fraction or percentage that the difference between the ETA and the scheduled arrival time is of the scheduled arrival time. In another example, the statistical measure of adherence may be a number of scheduled waypoints in a schedule of the vehicle system 104 that the vehicle system 104 arrives at or passes by later than the associated scheduled time or later than a time window after the scheduled time. Alternatively, the statistical measure of adherence may be a sum total, average, median, or other calculation of time differences between the actual times that the vehicle system 104 arrives at or passes by scheduled waypoints and the associated scheduled times.

Table 1 below provides examples of statistical measures of adherence of a vehicle system 104 to an associated schedule in a movement plan. Table 1 includes four columns and seven rows. Table 1 represents at least a portion of a schedule of the vehicle system 104. Several tables may be calculated for different schedules of different vehicle systems 104 in the movement plan for the transportation network 100 (shown in FIG. 1). The first column provides coordinates of scheduled locations that the vehicle system 104 is to pass through or arrive at the corresponding scheduled times shown in the second column. The coordinates may be coordinates that are unique to a transportation network 100 or that are used for several transportation networks (e.g., Global Positioning System coordinates). The numbers used for the coordinates are provided merely as examples. Moreover, information regarding the scheduled location other than coordinates may be used.

TABLE 1

| Scheduled Location (SL) | Scheduled Time | Actual Time at SL | Difference |
|---|---|---|---|
| (123.4, 567.8) | 09:00 | 09:00 | 0 |
| (901.2, 345.6) | 09:30 | 09:33 | (0:03) |
| (789.0, 234.5) | 10:15 | 10:27 | (0:12) |
| (678.9, 345.6) | 10:43 | 10:44 | (0:01) |
| (987.6, 543.2) | 11:02 | 10:58 | 0:04 |
| (109.8, 765.4) | 11:15 | 11:14 | 0:01 |
| (321.0, 987.5) | 11:30 | 11:34 | (0:04) |

The third column includes a list of the actual times that the vehicle system 104 arrives at or passes through the associated scheduled location. For example, each row in Table 1 includes the actual time that the vehicle system 104 arrives at or passes through the scheduled location listed in the first column for the corresponding row. The fourth column in Table 1 includes a list of differences between the scheduled times in the second column and the actual times in the third column for each scheduled location.

The differences between when the vehicle system 104 arrives at or passes through one or more scheduled locations and the time that the vehicle system 104 was scheduled to arrive at or pass through the scheduled locations may be used to calculate the statistical measure of adherence to a schedule for the vehicle system 104. In one embodiment, the statistical measure of adherence for the vehicle system 104 may represent the number or percentage of scheduled locations that the vehicle system 104 arrived too early or too late. For example, the monitoring module 204 may count the number of scheduled locations that the vehicle system 104 arrives at or passes through outside of a time buffer around the scheduled time. The time buffer can be one to several minutes. By way of example only, if the time buffer is three minutes, then the monitoring module 204 may examine the differences between the scheduled times (in the second column of Table 1) and the actual times (in the third column of Table 1) and count the number of scheduled locations that the vehicle system 104 arrived more than three minutes early or more than three minutes late.

Alternatively, the monitoring module 204 may count the number of scheduled locations that the vehicle system 104 arrived early or late without regard to a time buffer. With respect to Table 1, the vehicle system 104 arrived at four of the scheduled locations within the time buffer of the scheduled times, arrived too late at two of the scheduled locations, and arrived too early at one of the scheduled locations.

The monitoring module 204 may calculate the statistical measure of adherence by the vehicle system 104 to the schedule based on the number or percentage of scheduled locations that the vehicle system 104 arrived on time (or within the time buffer). In the illustrated embodiment, the monitoring module 204 can calculate that the vehicle system 104 adhered to the schedule (e.g., remained on schedule) for 57% of the scheduled locations and that the vehicle system 104 did not adhere (e.g., fell behind or ahead of the schedule) for 43% of the scheduled locations.

Alternatively, the monitoring module 204 may calculate the statistical measure of adherence by the vehicle system 104 (shown in FIG. 1) to the schedule based on the total or sum of time differences between the scheduled times associated with the scheduled locations and the actual times that the vehicle system 104 arrived at or passed through the scheduled locations. With respect to the example shown in Table 1, the monitoring module 204 may sum the time differences shown in the fourth column as the statistical measure of adherence. In the example of Table 1, the statistical measure of adherence is −15 minutes, or a total of 15 minutes behind the schedule of the vehicle system 104.

In another embodiment, the monitoring module 204 may calculate the average statistical measure of adherence by comparing the deviation of each vehicle system 104 from the average or median statistical measure of adherence of the several vehicle systems 104 traveling in the transportation network 100 (shown in FIG. 1). For example, the monitoring module 204 may calculate an average or median deviation of the measure of adherence for the vehicle systems 104 from the average or median statistical measure of adherence of the vehicle systems 104.

The monitoring module 204 may determine the throughput parameters for the transportation network 100 (shown in FIG. 1), or an area thereof, based on the statistical measures of adherence associated with the vehicle systems 104. For example, a throughput parameter may be an average, median, or other statistical calculation of the statistical measures of adherence for the vehicle systems 104 concurrently traveling in the transportation network 100. The throughput parameter may be calculated based on the statistical measures of adherence for all, substantially all, a supermajority, or a majority of the vehicle systems 104 traveling in the transportation network 100.

The scheduling module 202 creates schedules for the vehicle systems 104 and transmits the schedules to the control systems 206 of the vehicle systems 104. In one embodiment, the scheduling module 202 conveys the schedules to the antenna 206, which transmits the schedules to antennas 208 of corresponding vehicle systems 104. The control systems 206 of the vehicle systems 104 receive the schedules sent by the scheduling system 110 and generate control signals to control propulsion of the vehicle systems 104 based on the schedules. In the illustrated embodiment, the control system 206 includes an energy management system 210 and a control unit 212. One or both of the energy management system 210 and the control unit 212 may be embodied in hardware, such as a processor, controller, or other logic-based device, that performs functions or operations based on one or more sets of instructions (e.g., software). The instructions on which the hardware operates may be stored on a tangible and non-transitory (e.g., not a transient signal) computer readable storage medium, such as a memory 214. The memory 214 may include one or more computer hard drives, flash drives, RAM, ROM, EEPROM, and the like. Alternatively, one or more of the sets of instructions that direct operations of the hardware may be hard-wired into the logic of the hardware.

The schedules that are received from the scheduling system 110 are conveyed to the energy management module 210 of the control system 206. In the illustrated embodiment, the energy management module 210 is disposed on-board the vehicle system 104. In another embodiment, the energy management module 210 may be disposed off-board the vehicle system 104. For example, the energy management module 210 can be disposed in a central dispatch or other office that generates the trip plans for one or more vehicle systems 104. The energy management module 210 generates a trip plan for the vehicle system 104 based on the schedule. As described above, the trip plan may include throttle settings, brake settings, designated speeds, or the like, of the vehicle system 104 for various sections of a scheduled trip of the vehicle system 104 to the scheduled destination location. The trip plan may be generated to reduce the amount of fuel that is consumed by the vehicle system 104 as the vehicle system 104 travels to the destination location relative to travel by the vehicle system 104 to the destination location when not abiding by the trip plan.

In order to generate the trip plan for the vehicle system 104, the energy management module 210 can refer to a trip profile that includes information related to the vehicle system 104, information related to the route 102 (shown in FIG. 1) over which the vehicle system 104 travels to arrive at the scheduled destination, and/or other information related to travel of the vehicle system 104 to the scheduled destination location at the scheduled arrival time. The information related to the vehicle system 104 may include information regarding the fuel efficiency of the vehicle system 104 (e.g., how much fuel is consumed by the vehicle system 104 to traverse different sections of a route 102), the tractive power (e.g., horsepower) of the vehicle system 104, the weight or mass of the vehicle system 104 and/or cargo, the length and/or other size of the vehicle system 104, the location of the powered units 106 (shown in FIG. 1) in the vehicle system 104 (e.g., front, middle, back, or the like of a vehicle consist having several mechanically interconnected units 106, 108), or other information. The information related to the route 102 to be traversed by the vehicle system 104 can include the shape (e.g., curvature), incline, decline, and the like, of various sections of the route 102, the existence and/or location of known slow orders or damaged sections of the route 102, and the like. Other information can include information that impacts the fuel efficiency of the vehicle system 104, such as atmospheric pressure, temperature, and the like.

The trip plan is formulated by the energy management module 210 based on the trip profile. For example, if the trip profile requires the vehicle system 104 (shown in FIG. 1) to traverse a steep incline and the trip profile indicates that the vehicle system 104 is carrying significantly heavy cargo, then the energy management module 210 may form a trip plan that includes or dictates increased tractive efforts to be provided by the propulsion subsystem 216 of the vehicle system 104. Conversely, if the vehicle system 104 is carrying a smaller cargo load and/or is to travel down a decline in the route 102 (shown in FIG. 1) based on the trip profile, then the energy management module 210 may form a trip plan that includes or dictates decreased tractive efforts by the propulsion subsystem 216 for that segment of the trip. In one embodiment, the energy management module 210 includes a software application or system such as the Trip Optimizer™ system provided by General Electric Company.

The control system 206 includes a control unit 212 that generates the control signals for controlling operations of the vehicle system 104. The control unit 212 may receive the trip plan from the energy management module 214 and generate the control signals that automatically change the tractive efforts and/or braking efforts of the propulsion subsystem 216 based on the trip plan. For example, the control unit 212 may form the control signals to automatically match the speeds of the vehicle system 104 with the speeds dictated by the trip plan for various sections of the trip of the vehicle system 104 to the scheduled destination location. Alternatively, the control unit 212 may form control signals that are conveyed to an output device 218 disposed on-board the vehicle system 104. The output device 216 can visually and/or audibly present instructions to an operator of the vehicle system 104 to change the tractive efforts and/or braking efforts of the vehicle system 104 based on the control signals. For example, the output device 218 can include a monitor, touchscreen, or other display device that visually presents textual instructions to the operator to increase or decrease the speed of the vehicle system 104 to match a designated speed of the trip plan.

As described above, the scheduling module 202 can create and/or modify a schedule of a vehicle systems 104 so that the vehicle system 104 arrives at a vehicle yard 112 (shown in FIG. 1) when the vehicle yard 112 has sufficient capacity to accept the vehicle system 104. In doing so, the vehicle system 104 may be able to enter the vehicle yard 112 without stopping and sitting outside the vehicle yard 112 until sufficient space in the vehicle yard 112 opens up for the vehicle system 104 to enter.

Figure 3:
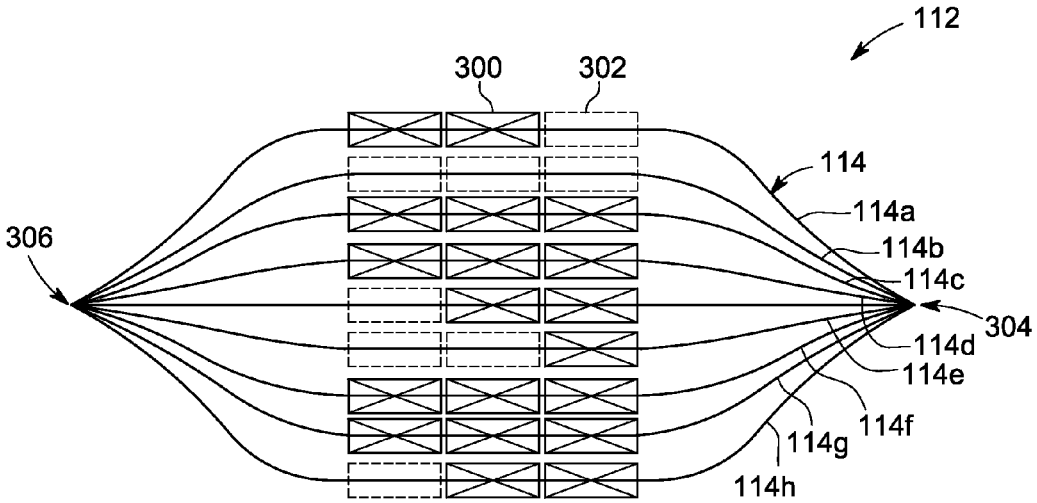
FIG. 3 is a schematic diagram of a vehicle yard shown in FIG. 1 in accordance with one embodiment.

FIG. 3 is a schematic diagram of a vehicle yard 112 in accordance with one embodiment. The vehicle yard 112 is shown with each of the interconnected routes 114 (e.g., the routes 114*a*, 114*b*, 114*c*, and so on) in the vehicle yard 112 having spaces 300, 302 for vehicle systems 104 (shown in FIG. 1). The spaces 300, 302 represent locations where one or more vehicle systems 104 may park or stop within the vehicle yard 112 for layover, which may include storage, repair, maintenance, loading or unloading of cargo, re-ordering of the vehicle systems 104, building of one or more vehicle systems 104 (e.g., connecting powered and/or unpowered vehicle systems with each other to form a vehicle system 104 such as a train), or other services. The vehicle systems 104 may enter the vehicle yard 112 through a first end 304 that is coupled with one or more of the routes 102 (shown in FIG. 1) of the transportation network 100 (shown in FIG. 1) and stop in one or more of the spaces 300, 302. The vehicle systems 104 may exit the vehicle yard 112 through the first end 304 and/or a second end 306 that is coupled with one or more of the routes 102. Although not shown in FIG. 3, the routes 114 may be connected with each other between the ends 304, 306 of the vehicle yard 112.

Each of the spaces 300, 302 may represent a designated size of space in the vehicle yard 112 for receiving one or more vehicle systems 104 (shown in FIG. 1). The spaces 300, 302 may represent an amount of volume, a length, or other measurement of size or space. The spaces 300 are shown with an X through the space to indicate that the space 300 in the vehicle yard 112 is occupied by one or more vehicle systems 104. The spaces 302 are shown with dashed lines to indicate that the space 302 in the vehicle yard 112 is empty or is otherwise available to receive one or more vehicle systems 104. The number of vehicle systems 104 that may be received in one or more of the spaces 302 and/or the number of vehicle systems 104 occupying the spaces 300 may vary based on the size (e.g., the length) of the vehicle systems 104. For example, larger or longer vehicle systems 104 may occupy more than one space 300, 302 while smaller or shorter vehicle systems 104 may occupy one space 300, 302 or a fraction of a space 300, 302.

The capacity of the vehicle yard 112 to receive additional vehicle systems 104 can be represented by the amount of available spaces 302 and/or the location of the available spaces 302. In the illustrated embodiment, there are eight available spaces 302. The vehicle yard 112 may be able to accept a corresponding size or length of vehicle systems 104. For example, on the route 114*a*, the vehicle yard 112 can accept one or more vehicle systems 104 that can fit into a single available space 302. On the route 114*b*, the vehicle yard 112 can accept one or more vehicle systems 104 that can fit into the three available spaces 302. The routes 114*c*, 114*d*, 114*f*, and 114*g* cannot accept any additional vehicle systems 104 as the spaces on these routes 114 are all occupied spaces 300. Other routes 114 have other amounts of available spaces 302.

As vehicle systems 104 enter into and/or leave the vehicle yard 112, the number or amount of available spaces 302 for receiving additional vehicle systems 104 may change. For example, if additional vehicle systems 104 enter into the vehicle yard 112, the number of available spaces 302 may decrease. Conversely, as vehicle systems 104 leave the vehicle yard 112, the number of available spaces 302 may increase.

Figure 4:
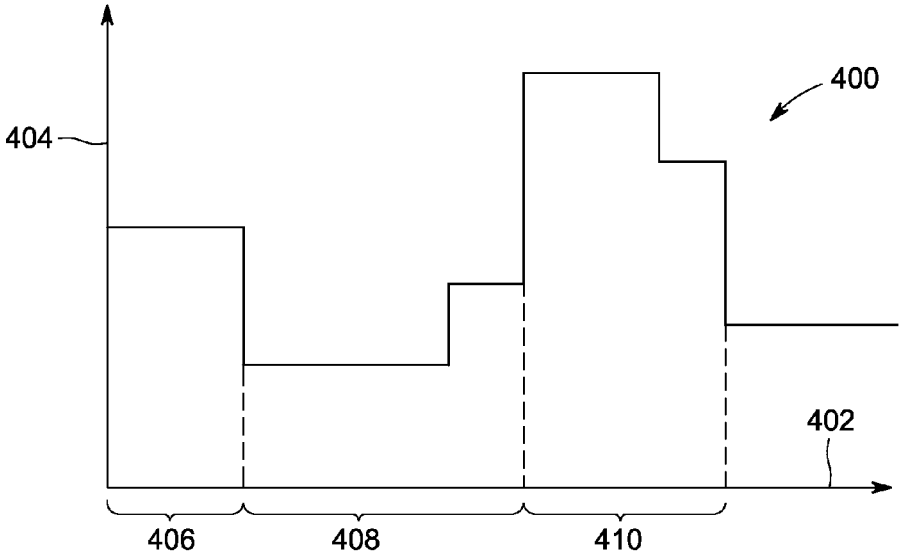
FIG. 4 is an illustration of one example of a capacity curve of the vehicle yard shown in FIG. 1.

FIG. 4 is an illustration of one example of a capacity curve 400 of a vehicle yard 112 (shown in FIG. 1). The capacity curve 400 represents the ability of the vehicle yard 112 to receive vehicle systems 104 (shown in FIG. 1) into the vehicle yard 112 over time. The capacity curve 400 is shown alongside a horizontal axis 402 representative of time and a vertical axis 404 representative of the capacity of the vehicle yard 112 to receive vehicle systems 104. The capacity may be expressed in an amount of available spaces 302 (shown in FIG. 3), an amount of available spatial volume, a length, or other measurement of size or numbers of vehicle systems 104 that can be received into the vehicle yard 112.

As shown in FIG. 4, the capacity of the vehicle yard 112 to receive vehicle systems 104 can change over time. For example, during a first time period 406, the vehicle yard 112 may have a greater capacity (e.g., more available space) to receive vehicle systems 104 than a subsequent second time period 408, but a smaller capacity to receive vehicle systems 104 relative to a subsequent third time period 410. The capacities of the vehicle yard 112 may determined at various times in order to determine when to schedule vehicle systems 104 to arrive at and enter into the vehicle yard 112.

Returning to the discussion of the scheduling system 110 shown in FIG. 2, the monitoring module 204 can determine when a vehicle yard 112 (shown in FIG. 1) has or will have sufficient capacity to receive a vehicle system 104. In one embodiment, the monitoring module 204 can project when the vehicle yard 112 will have sufficient capacity to receive the vehicle system 104 based on the schedules of other vehicle systems 104. For example, the monitoring module 204 can examine the schedules of vehicle systems 104 traveling in or through the transportation network 100 (shown in FIG. 1). The schedules may indicate which vehicle systems 104 are scheduled to travel to a vehicle yard 112, when the vehicle systems 104 are scheduled to enter into the vehicle yard 112, and/or how long the vehicle systems 104 are scheduled to be in the vehicle yard 112. Based on this information, the monitoring module 204 can estimate a projected or expected capacity of the vehicle yard 112 at one or more times in the future.

Alternatively, the monitoring module 204 may predict the capacity of the vehicle yard 112 (shown in FIG. 1) based on a trend of previous capacities of the vehicle yard 112. For example, the monitoring module 204 can monitor the capacity of the vehicle yard 112 in real time. By "real time," it is meant that the monitoring module 204 may calculate the capacity of the vehicle yard 112 and change the calculated capacity as vehicle systems 104 enter into and/or leave the vehicle yard 112. For example, after calculating the capacity of the vehicle yard 112, the monitoring module 204 may add to the capacity when one or more vehicle systems 104 leave the vehicle yard 112 and/or subtract from the capacity when one or more vehicle systems 104 enter into the vehicle yard 112. The monitoring module 204 may generate a history of the capacities of the vehicle yard 112 and identify one or more patterns or trends in the history over time. For example, the monitoring module 204 may determine that the vehicle yard 112 has greater capacities during one or more time windows of one or more days of the week, month, year, or the like. The monitoring module 204 may project the capacities of the vehicle yard 112 based on such a history of the capacities.

The scheduling module 202 creates and/or modifies schedules of vehicle systems 104 based on the projected or expected capacities of the vehicle yards 112 (shown in FIG. 1). For example, the scheduling module 202 may examine a previously generated schedule for a vehicle system 104 to determine when the vehicle system 104 is scheduled to arrive and enter into a vehicle yard 112. The scheduled time of entry into the vehicle yard 112 can be referred to as a "scheduled time of entry." The scheduling module 202 can determine a projected or expected capacity of the vehicle yard 112 to receive the vehicle system 112 at the scheduled time of entry. If there is sufficient capacity for the vehicle yard 112 to receive the vehicle system 104 at the scheduled time of entry, then the scheduling module 202 may not change the scheduled time of entry. On the other hand, if there is insufficient capacity at the scheduled time of entry, then the scheduling module 202 may determine if the scheduled time of entry should be changed, such as by delaying or advancing the scheduled time of entry. The scheduling module 202 can determine one or more alternate times of entry by projecting the capacities of the vehicle yard 112 at various other times and selecting an updated time of entry for the vehicle system 104 based on when the projected capacity of the vehicle yard 112 is large enough to receive the vehicle system 104. In one embodiment, the scheduling module 202 delays the scheduled time of entry for a vehicle system 104 to a later updated time of entry that corresponds to a time when the projected capacity of the vehicle yard 112 is large enough to receive the size of the vehicle system 104.

The scheduling module 202 may modify the time of entry for a vehicle system 104 as the vehicle system 104 approaches the vehicle yard 112 (shown in FIG. 1). For example, the scheduling module 202 may delay the time of entry for the vehicle system 104 as the vehicle system 104 travels toward the vehicle yard 112 along one or more of the routes 102 (shown in FIG. 1). The scheduling module 202 may periodically or irregularly (e.g., when prompted by an operator) check on the projected capacity of the vehicle yard 112 to receive the vehicle system 104 in order to account for unexpected or unplanned changes in the capacity of the vehicle yard 112 and/or the travel of the vehicle system 104. For example, the scheduling module 202 may check on the projected capacity when the vehicle system 104 falls behind schedule due to one or more other vehicle systems 104 interfering with the travel of the vehicle system 104 headed toward the vehicle yard 112, slow orders or other temporary low speed limits on the routes 102, damaged sections of the routes 102, mechanical damage or need for repair to the vehicle system 104, and the like. If the projected capacity is insufficient for the vehicle system 104, then the scheduling module 202 may change the scheduled time of entry while the vehicle system 104 is traveling toward the vehicle yard 112.

In one embodiment, the scheduling module 202 transmits the updated time of entry to the control system 206 of the vehicle system 104. Alternatively, the scheduling module 202 may transmit an updated schedule for the vehicle system 104 that includes the updated time of entry. The control system 206 receives the updated time of entry and may change a time at which the vehicle system 104 arrives at and/or enters the vehicle yard 112. For example, the control unit 212 may reduce the speed of the vehicle system 104 so that the vehicle system 104 arrives at and/or enters the vehicle yard 112 at a later time of entry than a previously scheduled time of entry.

In one embodiment, the updated time of entry is communicated to the energy management system 210. The energy management system 210 can determine an updated trip plan based on the updated time of entry. For example, the energy management system 210 can modify a previously created trip plan or create a new trip plan (either which can be referred to as an updated trip plan) that is based on arriving and/or entering the vehicle yard 112 at the updated time of entry. The updated trip plan can include tractive efforts, braking efforts, speeds, or the like, for different sections of the trip of the vehicle system 104 to the vehicle yard 112 such that the vehicle system 104 arrives at and/or enters the vehicle yard 112 at the updated time of entry. The updated trip plan can be used by the control unit 212 to generate control signals that are used to control the propulsion subsystem 216 of the vehicle system 104, as described above. As a result, the vehicle system 104 may travel to the vehicle yard 112 using an updated trip plan that causes the vehicle system 104 to arrive at the vehicle yard 112 when the vehicle yard 112 has capacity to receive the vehicle system 104, whereby the vehicle system 104 consumes less fuel than if the vehicle system 104 were to travel to the vehicle yard 112 and arrive at the updated time of entry according to a different trip plan.

The scheduling module 202 may send the updated time of entry to the vehicle system 104 when doing so will not result in one or more throughput parameters of the transportation network 100 (shown in FIG. 1) falling below a predetermined threshold, such as a non-zero threshold. That is, the scheduling module will only send the updated time of entry to the vehicle system if the vehicle system changing speed to arrive at the vehicle yard at the updated time would not result in a throughput parameter falling below a predetermined threshold. For example, the scheduling module 202 may not send the updated time of entry to the vehicle system 104 when sending the updated time of entry to the vehicle system 104 will cause the vehicle system 104 to change a trip plan of the vehicle system 104 that results in an increase, or a significant increase, in traffic congestion in the transportation network 100.

In one embodiment, the scheduling module 202 may generate several different sets of potential schedules for the vehicle systems 104 (shown in FIG. 1), with at least one of the potential schedules including an updated time of entry for one or more of the vehicle systems 104 to arrive at the vehicle yard 112. The monitoring module 204 can simulate travel of the vehicle systems 104 according to the potential schedules in each of the sets and calculate simulated throughput parameters associated with the different sets of the schedules. The monitoring module 204 can compare the simulated throughput parameters of the different sets and, based on the comparison, select one of the sets of schedules to send to the vehicle systems 104 for use in traveling in the transportation network 100 (shown in FIG. 1). For example, the scheduling module 206 may select the set of schedules having the largest throughput parameter, or a throughput parameter that is larger than one or more other throughput parameters associated with one or more other sets of schedules, and send the selected set of schedules to the vehicle systems 104, including the schedule having the updated time of entry into the vehicle yard 112.

Alternatively, the scheduling module 202 may generate a set of schedules with at least one schedule including the updated time of entry into the vehicle yard 112 and the monitoring module 204 can simulate travel of the vehicle systems 104 in the transportation network 100 according to the set of schedules. The monitoring module 204 can calculate a simulated throughput parameter for the set. If the simulated throughput parameter of the set exceeds a predesignated threshold, such as a non-zero threshold, then the scheduling module 202 may select that set of schedules to send to the vehicle systems 104, including the set having the updated time of entry into the vehicle yard 112. If the simulated throughput parameter does not exceed the threshold, then the scheduling module 202 may generate another, different set of schedules and calculate another simulated throughput parameter. The scheduling module 202 may continue generating sets of schedules and simulating throughput parameters until a simulated throughput parameter of a set exceeds the threshold. If no simulated throughput parameter exceeds the threshold, then the scheduling module 206 may select the set of schedules having a simulated throughput parameter that is larger than the other simulated throughput parameters or the set having a simulated throughput parameter that is greater than the simulated throughput parameter of one or more other sets of schedules.

In another embodiment, the scheduling module 202 may change the time of entry for a vehicle system 104 to enter into the vehicle yard 112 based on a confidence parameter. The confidence parameter may represent a probability that changing the time of entry for one or more vehicle systems 104 will not negatively impact one or more throughput parameters of the transportation network 100 (shown in FIG. 1). For example, the confidence parameter may be calculated as a probability that changing the time of entry for one or more vehicle systems 104 will not decrease the flow of travel in the transportation network and/or increase traffic congestion in the transportation network 100. If the confidence parameter is sufficiently high, such as by being greater than a predetermined threshold, the scheduling module 202 can change the time of entry of one or more vehicle systems 104 to enter one or more vehicle yards 112. Such a confidence parameter can indicate that modifying the time of entry (e.g., by delaying the time of entry) is unlikely to negatively impact the throughput parameter of the transportation network 100. Conversely, if the confidence parameter is too low, such as by not exceeding the predetermined threshold, then the confidence parameter can indicate that modifying the previously scheduled time of entry for one or more vehicle systems 104 may negatively impact the throughput parameter, such as by decreasing the throughput parameter and increasing congestion (e.g., causing more vehicle systems 104 to fall behind schedule) in the transportation network 100. The monitoring module 204 may determine the confidence parameter in one embodiment. Alternatively, the scheduling module 202 or another module or component may calculate the confidence parameter.

In one embodiment, the confidence parameter is based on a closing distance between the vehicle system 104 whose time of entry may be changed and the location of the vehicle yard 112. The "closing distance" means a distance between a location of the vehicle system 104 and the vehicle yard 112. If the confidence parameter is calculated at the same time that the vehicle system 104 is traveling toward the vehicle yard 112, then the closing distance may represent the distance between a current or last detected location of the vehicle system 104 (e.g., as determined by a Global Positioning System receiver of the vehicle system 104 or as otherwise input into the scheduling system 110) and the location of the vehicle yard 112. The confidence parameter may be inversely related to the closing distance. For example, the confidence parameter may be smaller for a larger closing distance (e.g., the vehicle system 104 is farther from the vehicle yard 112) and the confidence parameter may increase as the closing distance decreases (e.g., as the vehicle system 104 moves toward the vehicle yard 112). The confidence parameter may be inversely related to the closing distance because, as the vehicle system 104 is farther from the vehicle yard 112, there can be a greater possibility or chance that the vehicle system 104 has additional scheduled or unscheduled delays in arriving at the vehicle yard 112 and/or that the vehicle system 104 will encounter other vehicle systems 104 and either be delayed by the other vehicle systems 104 or cause delay in the travel of the other vehicle systems 104. A scheduled delay may include a scheduled stop of the vehicle system 104 and an unscheduled delay may include an unplanned obtrusion blocking travel of the vehicle system 104, a change in the movement plan for the vehicle system 104, unforeseen damage to the route 102, and the like. A variety of factors may be considered when forming the inverse relationship between the closing distance and the confidence parameter, such as information related to the route 102 (e.g., the grade, curvature, location of damaged portions, and the like), information related to the vehicle system 104 (e.g., length or other size of the vehicle system 104), or other information.

Figure 5:
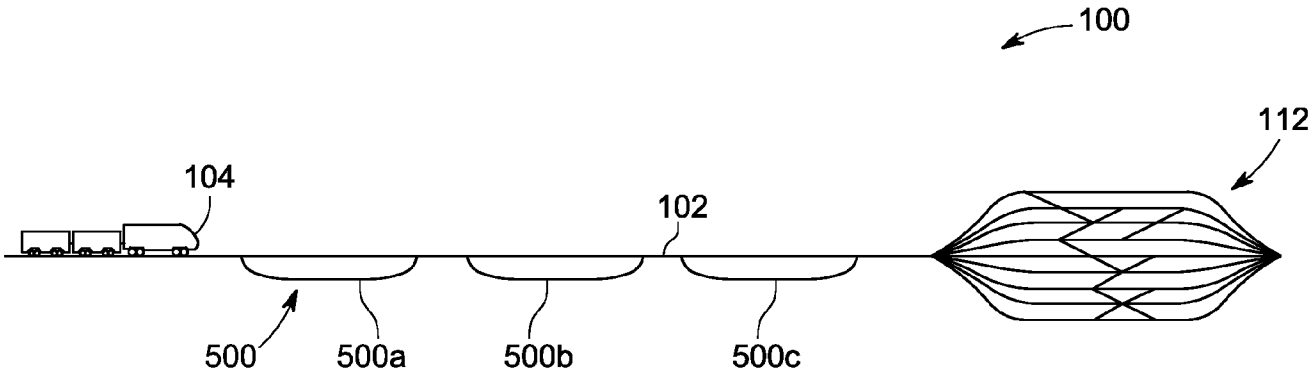
FIG. 5 is a schematic diagram of a portion of the transportation network shown in FIG. 1 in accordance with one embodiment.

FIG. 5 is a schematic diagram of a portion of the transportation network 100 in accordance with one embodiment. The illustrated portion of the transportation network 100 includes a route 102, such as a main line route, with several siding route sections 500 connected with the route 102. A siding route section 500 may include a section of a track, road, or other path that is connected with the route 102 and that provides an auxiliary path for a vehicle system 104 to pull off of the route 102. For example, a first vehicle system 104 may pull off the main line route 102 and onto a siding route section 500 to allow a second vehicle system 104 traveling on the same main line route 102 in the same or opposite direction to pass the first vehicle system 104 on the main line route 102. In the illustrated embodiment, there are three siding route sections 500 disposed between the vehicle system 104 and the vehicle yard 112. Alternatively, there may be a different number of siding route sections 500. The siding route sections 500 (e.g., sections 500*a*, 500*b*, 500*c*, and so on).

The confidence parameter may have a value that is based on the number of siding route sections 500 between the vehicle system 104 and the vehicle yard 112. For example, with respect to the embodiment shown in FIG. 5, there are three siding route sections 500 between the vehicle system 104 and the vehicle yard 112. The confidence parameter calculated for changing the time of entry for the vehicle system 104 to enter the vehicle yard 112 may increase if more than three siding route sections 500 are disposed between the vehicle system 104 and the vehicle yard 112 and may decrease if less than three siding route sections 500 are disposed between the vehicle system 104 and the vehicle yard 112. The confidence parameter may be related to the number of siding route sections 500 in a linear or non-linear relationship. For example, with respect to a linear relationship, as the number of siding route sections 500 within the closing distance of the vehicle system 104 increases, the confidence parameter may increase by a number or constant multiplied by the number of the siding route sections 500. With respect to a non-linear relationship, the confidence parameter may change by different amounts for each incremental change in the number of siding route sections 500 in the closing distance.

The confidence parameter may change based on the number of siding route sections 500 because additional siding route sections 500 can provide locations for the vehicle system 104 to pull off of the main line route 102 and get out of the way of other vehicle systems 104 traveling on the main line route 102. For example, delaying the time of entry for the vehicle system 104 can cause the vehicle system 104 to travel more slowly toward the vehicle yard 112. As the vehicle system 104 slows down, the vehicle system 104 may risk impeding the flow of traffic in the transportation network 100 by impeding the travel of other vehicle systems 104 traveling on, or scheduled to travel on, the same main line route 102. Having siding section routes 500 between the vehicle system 104 and the vehicle yard 112 can provide locations for the vehicle system 104 to move out of the way of other vehicle systems 104 to avoid significantly impeding the flow of traffic in the transportation network 100 while allowing the vehicle system 104 to arrive at the vehicle yard 112 at the updated time of entry.

Figure 6:
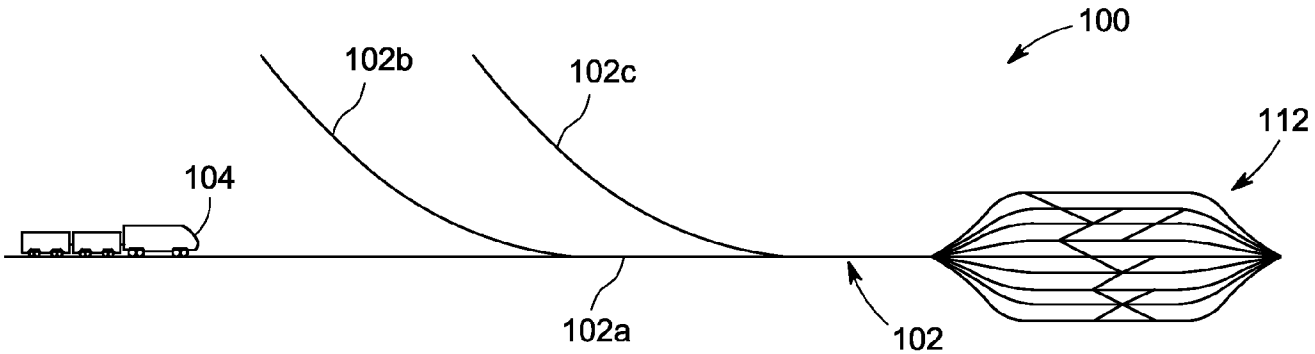
FIG. 6 is a schematic diagram of another portion of the transportation network shown in FIG. 1 in accordance with one embodiment.

FIG. 6 is a schematic diagram of another portion of the transportation network 100 in accordance with one embodiment. The illustrated portion of the transportation network 100 includes a first route 102, such as a main line route, with several additional routes 102 connected with the first route 102. Although three routes 102 (e.g., routes 102*a*, 102*b*, 102*c*) are shown in FIG. 6, alternatively, a different number of routes 102 may be used.

As shown in FIG. 6, the routes 102 intersect each other. In the illustrated embodiment, the second and third routes 102*b*, 102*c* converge with the first route 102*a* such that vehicle systems 104 traveling on the second and third routes 102*b* and/or 102*c* toward the vehicle yard 112 may merge onto the first route 102*a* from the second and/or third routes 102*b*, 102*c*. Conversely, vehicle systems 104 traveling on the first route 102*a* away from the vehicle yard 112 may exit the first route 102*a* onto the second or third route 102*b*, 102*c*. In another embodiment, the intersection between two or more of the routes 102 may be configured differently. For example, instead of the route 102*b*, 102*c* merging into the route 102*a* in a left-to-right direction in the view shown in FIG. 6, one or more of the routes 102*b*, 102*c* may merge into the route 102*a* in a right-to-left direction, or may otherwise be coupled with the route 102*a*.

The confidence parameter may have a value that is based on the number of intersections between the route 102 that a vehicle system 104 is traveling on toward a vehicle yard 112 and another route 102 within the closing distance of the vehicle system 104 to the vehicle yard 112. For example, the confidence parameter may increase with increasing intersections within the closing distance of the vehicle system 104 and may decrease with decreasing intersections within the closing distance. The confidence parameter may be related to the number of intersections in a linear or non-linear relationship. For example, with respect to a linear relationship, as the number of intersections within the closing distance of the vehicle system 104 increases, the confidence parameter may increase by a number or constant multiplied by the number of the intersections. With respect to a non-linear relationship, the confidence parameter may increase or decrease by different amounts for each incremental change in the number of intersections in the closing distance. The confidence parameter may change based on the number of intersections because additional intersections can provide locations for other vehicle systems 104 to interact with the vehicle system 104 heading to the vehicle yard 112. For example, as more routes 102 intersect the first route 102 on which the vehicle system 104 is traveling, the possibility that other vehicle systems 104 may enter onto the first route 102 from the intersecting routes 102 increases. As the possibility that other vehicle systems 104 may enter onto the first route 102*a* increases, the potential for the travel of the other vehicle systems 104 to be impeded or slowed down by the vehicle system 104 having an updated or delayed time of entry into the vehicle yard 112 may increase. As a result, the confidence parameter may decrease as the number of intersections increases.

Figure 7:
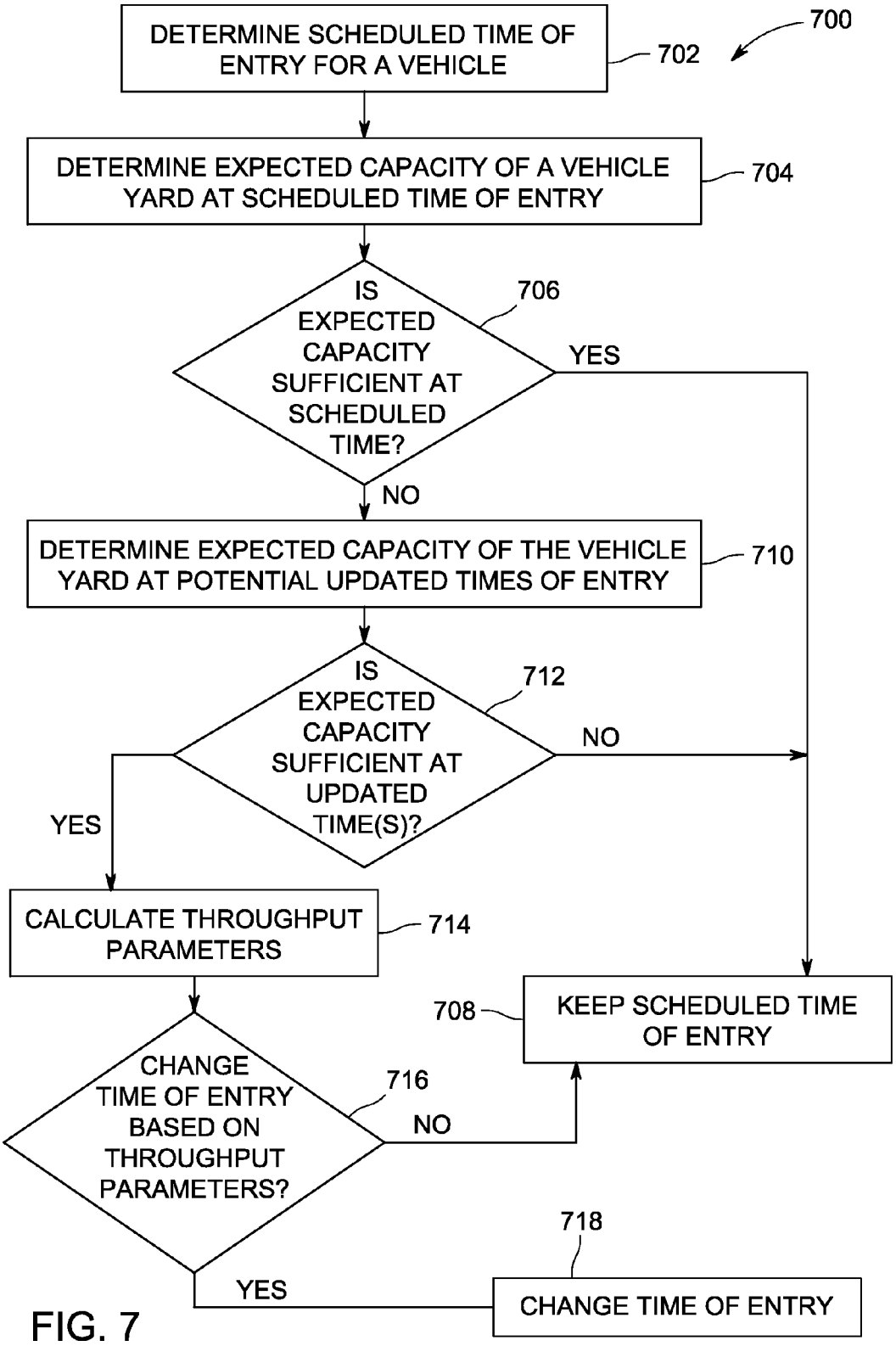
FIG. 7 is a flowchart of one embodiment of a method for scheduling travel of vehicles in a transportation network.

FIG. 7 is a flowchart of one embodiment of a method 700 for scheduling travel of vehicle systems in a transportation network. The method 700 may be used to schedule when a vehicle system 104 (shown in FIG. 1) arrives and/or enters into a vehicle yard 112 (shown in FIG. 1), in accordance with one or more embodiments described above.

At 702, a time of entry that is scheduled for the vehicle system 104 is determined. For example, the vehicle system 104 may have or be associated with a schedule that dictates travel of the vehicle system 104 in or through the transportation network 100 (shown in FIG. 1). The schedule may include directions for the vehicle system 104 to travel to a vehicle yards 112 at the time of entry.

At 704, an expected capacity of the vehicle yard 112 to receive the vehicle system 104 at the scheduled time of entry is determined. As described above, the expected capacity may be an estimated or calculated capacity of the vehicle yard 112 at the upcoming originally scheduled time of entry.

At 706, a determination is made as to whether the expected capacity of the vehicle yard 112 at the scheduled time of entry is sufficient for the vehicle yard 112 to receive the vehicle system 104 at the scheduled time of entry. For example, the expected capacity may be compared to a length or other size of the vehicle system 104. If the expected capacity is sufficiently large to receive the vehicle system 104 at the scheduled time of entry, then the scheduled time of entry may not need to be changed. For example, the time of entry for the vehicle system 104 may not need to be changed because the vehicle yard 112 will be able to accept the vehicle system 104. As a result, flow of the method 700 may proceed to 708.

On the other hand, if the expected capacity is not large enough to receive the vehicle system 104, then the time of entry may need to be changed (e.g., advanced or delayed) to avoid the vehicle system 104 traveling to a location outside of the vehicle yard 112 and waiting (e.g., stopping and idling) outside of the vehicle yard 112 for the vehicle yard 112 to have sufficient capacity to receive the vehicle system 104. As a result, the flow of the method 700 flows to 710.

At 710, the expected capacity of the vehicle yard 112 is determined for one or more potential updated times of entry. For example, the expected capacities of the vehicle yard 112 can be calculated at times other than the previously scheduled time of entry.

At 712, a determination is made as to whether the expected capacity of the vehicle yard 112 at one or more of the potential updated times of entry is sufficient for the vehicle yard 112 to receive the vehicle system 104 at the potential updated times of entry. If the expected capacity is sufficiently large to receive the vehicle system 104 at one or more of the potential updated times of entry, then the previously scheduled time of entry may be changed to the one or more of the potential updated times of entry. For example, the time of entry for the vehicle system 104 may be delayed to a later time so that the vehicle yard 112 will have space to receive the vehicle system 104 when the vehicle system 104 arrives at the vehicle yard 112. As a result, flow of the method 700 may proceed to 714.

On the other hand, if the expected capacity is not large enough to receive the vehicle system 104 at the potential updated times of entry, then the previously scheduled time of entry may not be changed (e.g., advanced or delayed). For example, the expected capacities of the vehicle yard 112 may be so low at the potential updated times of entry that changing the previously scheduled time of entry may be unsuccessful in getting the vehicle system 104 to the vehicle yard 112 just in time when the vehicle yard 112 has space for the vehicle system 104. As a result, flow of the method 700 proceeds to 708.

At 714, one or more throughput parameters of the transportation network 100 are calculated at the potential updated times. For example, estimated throughput parameters may be calculated for the transportation network 100 at the potential updated times of entry that the vehicle yard 112 may have sufficient capacity to receive the vehicle system 104. As described above, the throughput parameters can represent the flow of traffic of the vehicle systems 104 in or through the transportation network 100 at the different potential updated times of entry.

At 716, the one or more throughput parameters associated with the potential updated times of entry at which the vehicle yard 112 has sufficient capacity are examined to determine if any of the throughput parameters are large enough to change the time of entry. For example, the throughput parameters may be compared to one or more thresholds and/or each other to determine if a threshold parameter is sufficiently large. If one or more of the throughput parameters exceed the thresholds and/or are otherwise sufficiently large, then the previously scheduled time of entry may be changed to the updated time of entry associated with one or more of the throughput parameters without significantly decreasing the flow of travel in the transportation network 100. For example, the largest throughput parameter may be selected, or a throughput parameter that is greater than one or more other throughput parameters may be selected, and the previously scheduled time of entry may be changed to the updated time of entry associated with the larger throughput parameter. As a result, flow of the method 700 proceeds to 718.

On the other hand, if the throughput parameters are not sufficiently large (e.g., do not exceed one or more thresholds), then the previously scheduled time of entry may not be able to be changed to the corresponding updated times of entry without negatively impacting the flow of traffic in the transportation network 100. For example, delaying the time of entry may cause the travel of other vehicle systems 104 in the transportation network 100 to be impeded or otherwise interfered with. If the throughput parameters are not sufficiently large, then flow of the method 700 may proceed to 708.

At 718, the previously scheduled time of entry associated with the throughput parameter and an expected capacity of the vehicle yard 112 that are sufficiently large is changed to the corresponding updated time of entry. As described above, the updated time of entry can be communicated to the vehicle system 104 and the control system 206 (shown in FIG. 2) of the vehicle system 104 may change the speed of the vehicle system 104 based on the updated time of entry. For example, the energy management module 210 may calculate a trip plan or modify a previously created trip plan for the vehicle system 104 to arrive at the vehicle yard 112 at the updated time of entry. As described above, the trip plan that is based on the updated time of entry may be followed by the vehicle system 104 in order to reduce the amount of fuel consumed by the vehicle system 104 in traveling to the vehicle yard 112.

At 708, the previously scheduled time of entry for the vehicle system 104 is not changed. For example, if the vehicle yard 112 is expected to have sufficient capacity to receive the vehicle system 104 at the previously scheduled time of entry, the vehicle yard 112 will not have sufficient capacity at the potential updated times of entry, and/or the throughput parameters associated with the potential updated times of entry are too low, then the time of entry for the vehicle system 104 may not be changed. As a result, the vehicle system 104 may continue to travel to the vehicle yard 112 in order to arrive at the previously scheduled time of entry.

In other embodiments, a first vehicle system is originally scheduled to arrive at a vehicle yard or other designated location (e.g., destination location) at a first scheduled time. Subsequent to the original schedule being generated, the scheduling system/module receives information indicating that the capacity of the vehicle yard has been or will be reduced such that there will be insufficient capacity for the vehicle yard to receive the first vehicle system at the first scheduled time. (It could be the case that the original schedule is generated with the system: (i) having no knowledge of capacity; (ii) knowing there is insufficient capacity at the first scheduled time, but the original schedule is generated anyway due to other constraints; or (iii) at the time the original schedule is generated, information is indicative of sufficient capacity at the first scheduled time, but situations at the vehicle yard change between when the original schedule is generated and the first scheduled time.) Alternatively or additionally, in the case of designated locations other than a vehicle yard, the scheduling system/module may otherwise determine that the first scheduled time is no longer appropriate for the first vehicle system to arrive at the designated location, for example, due to newly-arisen conflicts with other vehicle systems at that time and location. Based on information of the vehicle yard (or other designated location) and/or information relating to other vehicle systems traveling in the transportation network, the scheduling system identifies a second scheduled time (e.g., earliest time) subsequent to the first scheduled time when the vehicle yard will have sufficient capacity to receive the first vehicle system. If slowing of the first vehicle system would not decrease a throughput parameter of the transportation network below a predetermined threshold, or if slowing the vehicle system would not otherwise interfere with other traffic in the network based on one or more designated criteria, then the scheduling system/module generates and sends an updated schedule to the first vehicle system, listing the second scheduled time as when the first vehicle system is now scheduled to arrive at the vehicle yard. Responsive to the updated schedule, a control system on the first vehicle system may cause the first vehicle system to slow, or the control system will otherwise control the first vehicle system based on the updated schedule. For example, the control system may generate an updated trip plan based on the updated schedule, for controlling the first vehicle system (e.g., automatically controlling the first vehicle system) to slow down linearly, or for controlling the vehicle system for non-linear and/or piecewise movement. In another embodiment, the updated schedule not only includes an updated, second scheduled time (of designated arrival at the vehicle yard or other location), but also other information of the transportation network, such as information related to other vehicle systems in the network, and/or objectives to achieve in controlling movement to the vehicle yard.

In another embodiment, a first vehicle system is originally scheduled to arrive at a vehicle yard or other designated location at a first scheduled time (e.g., original scheduled time). Subsequent to the original schedule being generated, the scheduling system/module receives information indicating that the capacity of the vehicle yard has been or will be reduced such that there will be insufficient capacity for the vehicle yard to receive the first vehicle system at the first scheduled time. Based on information of the vehicle yard and/or information relating to other vehicle systems traveling in the transportation network, the scheduling system/module identifies a second scheduled time (e.g., earliest time) subsequent to the first scheduled time when the vehicle yard will have sufficient capacity to receive the first vehicle system. In addition to identifying the second scheduled time, the scheduling system/module also automatically assesses how revising the velocity profile (e.g., slowing) of the first vehicle system might affect the travel of other, second vehicle systems in the transportation network. If revising the velocity profile in a particular manner would be deemed as excessively interfering with other vehicle systems based on designated criteria, then the scheduling system/module determines at least one other revised velocity profile, or related information (such as intermediate waypoints that are scheduled in regards to time and location of the first vehicle system), that would allow the first vehicle system, when correspondingly controlled, to arrive at the vehicle yard (or other designated location) at the second scheduled time but without interfering with other vehicle systems. Alternatively, the scheduling system/module, as part of the updated schedule provided to the first vehicle system, may provide both the second scheduled time and information on other vehicle systems to the first vehicle system; in such a case, a control unit on the first vehicle system is configured to determine a velocity profile to arrive at the vehicle yard (or other designated location) at the second scheduled time while avoiding interfering with other, second vehicle systems.

As an example of such embodiments, a system (e.g., system for controlling movement of vehicle systems in a transportation network) comprises a control unit configured to be disposed on-board a first vehicle system that moves along a route of a transportation network having a vehicle yard or other designated location. The control unit is configured to receive (from off-board the first vehicle system) an updated time of entry into the vehicle yard for the first vehicle system; more generally, the control unit may be configured to receive an updated time of arrival for the first vehicle system at a designated location. (The updated time comprises an updated scheduled time of entry/arrival, e.g., the first vehicle system was previously scheduled to arrive at a previous time and is newly scheduled to arrive at the updated time.) The control unit is also configured to change a speed of the first vehicle system in response to the updated time of entry/arrival. The control unit is further configured to receive (from off-board the first vehicle system) one or more scheduled waypoints between a current location of the first vehicle system and the vehicle yard or other designated location. Each of the one or more scheduled waypoints is defined by a location of the waypoint and a scheduled time of arrival of the first vehicle system at the waypoint. Alternatively or additionally, the control unit may be further configured to receive information of movement of at least one second vehicle system in the transportation network. (The second vehicle system is different and distinct from the first vehicle system, e.g., the two are not mechanically linked to travel together.) In either or both cases, the control unit is further configured to change the speed of the first vehicle system to meet the one or more scheduled waypoints, and/or to change the speed of the first vehicle system to meet one or more criteria relating to the movement of the at least one second vehicle system and to arrive at the vehicle yard or other designated location at the updated time.

In another embodiment of the system, the control unit is further configured to select a revised velocity profile for the first vehicle system, relative to a current velocity profile of the first vehicle system, that meets the one or more criteria relating to the movement of the at least one second vehicle system and for arrival of the first vehicle system at the vehicle yard (or other designated location) at the updated time. The velocity profiles may represent one or more speeds that the first vehicle system is to travel at or between various locations. (As an example, the one or more criteria may comprise travel of the first vehicle system according to the revised velocity profile not affecting the movement of the at least one second vehicle system.) The control unit is further configured to change the speed of the first vehicle system according to the revised velocity profile. The revised velocity profile may be selected as part of or in conjunction with a trip plan for the first vehicle system generated by an energy management system of the vehicle system; thus, characterizations of the control unit selecting a revised profile include an energy management system doing so, i.e., the energy management system may be considered functionally part of the control unit.

In another embodiment of the system, the control unit is further configured to select the revised velocity profile for the first vehicle system so that travel of the first vehicle system according to the revised velocity profile would result in less fuel used and/or fewer emissions generated than travelling according to the current velocity profile.

As another example of such embodiments, a method (e.g., method for controlling a vehicle system) comprises a step of receiving, at a first vehicle system that is moving along a route of a transportation network that includes the vehicle yard (or other designated location), an updated time of entry for the first vehicle system into the vehicle yard. More generally, the updated time may be an updated time of arrival of the first vehicle system at a designated location. (The updated time comprises an updated scheduled time of entry/arrival, e.g., the first vehicle system was previously scheduled to arrive at a previous time and is newly scheduled to arrive at the updated time.) The updated time is received from off-board the first vehicle system. The method further comprises a step of changing a speed of the first vehicle system in response to the updated time of entry (or arrival). The method further comprises a step of receiving (from off-board the first vehicle system) one or more scheduled waypoints between a current location of the first vehicle system and the vehicle yard or other designated location. Each of the one or more scheduled waypoints is defined by a location of the waypoint and a scheduled time of arrival of the first vehicle system at the waypoint. The speed of the first vehicle system is changed to meet the one or more scheduled waypoints (meaning the first vehicle system is controlled to arrive at the location of each waypoint at the scheduled time of the waypoint) and to arrive at the vehicle yard or other designated location at the updated time.

In another embodiment, a method comprises a step of receiving, at a first vehicle system that is moving along a route of a transportation network that includes the vehicle yard (or other designated location), an updated time of entry for the first vehicle system into the vehicle yard. (The updated time may otherwise be an updated scheduled time of arrival for the first vehicle system at another designated location.) The updated time is received from off-board the first vehicle system. The method further comprises a step of receiving, at the first vehicle system, information of movement of at least one second vehicle system in the transportation network. The speed of the first vehicle system is changed to meet one or more criteria relating to the movement of the at least one second vehicle system and to arrive at the vehicle yard at the updated time. In another embodiment, the method further comprises a step of selecting a revised velocity profile for the first vehicle system, relative to a current velocity profile of the first vehicle system, that meets the one or more criteria relating to the movement of the at least one second vehicle system and for arrival of the first vehicle system at the vehicle yard at the updated time. Here, the speed of the first vehicle system is changed according to the revised velocity profile. In other embodiments, the revised velocity profile for the first vehicle system is selected so that travel of the first vehicle system according to the revised velocity profile would result in less fuel used than travelling according to the current velocity profile.

In another embodiment, a system (e.g., a system for scheduling movement of vehicle systems in a transportation network) comprises a monitoring module configured to track a capacity of a vehicle yard (or other designated facility or location) in a transportation network to receive vehicle systems for layover in the vehicle yard over time. The system additionally comprises a scheduling module configured to determine an updated time of entry for (arrival at) a first vehicle system to enter the vehicle yard based on the capacity of the vehicle yard at the updated time of entry. The scheduling module is configured to communicate the updated time of entry to the first vehicle system so that the first vehicle system can change speed as the first vehicle system moves toward the vehicle yard. The monitoring module is further configured to monitor movement of at least one second vehicle system in the transportation network. The scheduling module is configured to select a revised velocity profile for the first vehicle system, relative to a current velocity profile of the first vehicle system, that meets one or more criteria relating to the movement of the at least one second vehicle system and for arrival of the first vehicle system at the vehicle yard at the updated time. Alternatively, in another embodiment, the scheduling module is configured to communicate information of the movement of the at least one second vehicle system to the first vehicle system for a control unit on the first vehicle system to select the revised velocity profile. In other embodiments, the scheduling unit or the control unit is configured to select the revised velocity profile for the first vehicle system so that travel of the first vehicle system according to the revised velocity profile would result in less fuel used than travelling according to the current velocity profile.

In another embodiment, a system (e.g., a system for scheduling movement of vehicle systems in a transportation network) comprises a monitoring module configured to monitor movement of a first vehicle system and at least one second vehicle system in a transportation network having plural routes over which the vehicle systems may travel. The system additionally comprises a scheduling module configured to determine an updated time of entry for a first vehicle system to enter a vehicle yard of the transportation network. (More generally, the scheduling module may be configured determine an updated time of arrival for the first vehicle system to arrive at another designated location of the transportation network. Also, the updated time comprises an updated scheduled time of entry/arrival, e.g., the first vehicle system was previously scheduled to arrive at a first, previous time and is newly scheduled to arrive at a second, updated time.) The scheduling module is configured to communicate the updated time of entry/arrival to the first vehicle system so that the first vehicle system can change speed as the first vehicle system moves toward the vehicle yard or other designated location. The scheduling module is configured to select a revised velocity profile for the first vehicle system, relative to a current velocity profile of the first vehicle system, that meets one or more criteria relating to the movement of the at least one second vehicle system and for arrival of the first vehicle system at the vehicle yard or other designated location at the updated time. Alternatively, in another embodiment, the scheduling module is configured to communicate information of the movement of the at least one second vehicle system to the first vehicle system for a control unit on the first vehicle system to select the revised velocity profile. In other embodiments, the scheduling unit or the control unit is configured to select the revised velocity profile for the first vehicle system so that travel of the first vehicle system according to the revised velocity profile would result in less fuel used than travelling according to the current velocity profile.

In another embodiment, a system (e.g., a system for scheduling movement of vehicle systems in a transportation network) comprises a monitoring module configured to monitor movement of a first vehicle system and at least one second vehicle system in a transportation network having plural routes over which the vehicle systems may travel. The system further comprises a scheduling module configured to determine a scheduled time of arrival for the first vehicle system to arrive at a designated location in the transportation network, e.g., the scheduled time of arrival may be an updated scheduled time of arrival, such as an updated scheduled time of entry into a vehicle yard. The scheduling module is configured to determine one or more scheduled waypoints between a current location of the first vehicle system and the designated location. The waypoints are determined based on the scheduled time of arrival and the movement of the first and second vehicle systems. Each of the one or more scheduled waypoints is defined by a location of the waypoint and a scheduled time of arrival of the first vehicle system at the waypoint. The one or more scheduled waypoints are determined such that movement of the first vehicle system to arrive at the one or more scheduled waypoints as scheduled and arrive at the designated location at the scheduled time of arrival meets one or more criteria in regards to movement of the at least one second vehicle system. For example, the one or more criteria may comprise movement of the first vehicle system as indicated not affecting the movement of the at least one second vehicle system. As another example, the one or more criteria may comprise movement of the first vehicle system as indicated not affecting the movement of the at least one second vehicle system by more than a designated threshold (e.g., not requiring the at least one second vehicle system to deviate from a planned speed or time by more than 10%). The scheduling module is configured to communicate the scheduled time of arrival and the one or more scheduled waypoints to the first vehicle system for the first vehicle system to change its speed to meet (i.e., arrive as scheduled at) the scheduled waypoints and the scheduled time of arrival at the designated location.

In another embodiment, a system (e.g., a system for scheduling movement of vehicle systems in a transportation network) comprises a monitoring module configured to track a capacity of a vehicle yard to receive plural vehicle systems for layover in the vehicle yard over time. The vehicle yard is part of a transportation network having plural routes over which the plural vehicle systems may travel. The monitoring module is further configured to monitor movement of a first vehicle system and at least one second vehicle system of the plural vehicle systems in the transportation network. The system further comprises a scheduling module configured to determine an updated time of entry for the first vehicle system to enter the vehicle yard based on the capacity of the vehicle yard at the updated time of entry. The scheduling module is further configured to determine one or more scheduled waypoints between a current location of the first vehicle system and the vehicle yard based on the updated time of entry and the movement of the first and second vehicle systems. Each of the one or more scheduled waypoints is defined by a location of the waypoint and a scheduled time of arrival of the first vehicle system at the waypoint. The one or more scheduled waypoints are determined such that movement of the first vehicle system to meet the scheduled waypoints and enter the vehicle yard at the updated time of entry meets one or more criteria in regards to movement of the at least one second vehicle system. The scheduling module is configured to communicate the updated time of entry and one or more scheduled waypoints to the first vehicle system for the first vehicle system to change its speed to meet the scheduled waypoints and updated time of entry.

Figure 8:
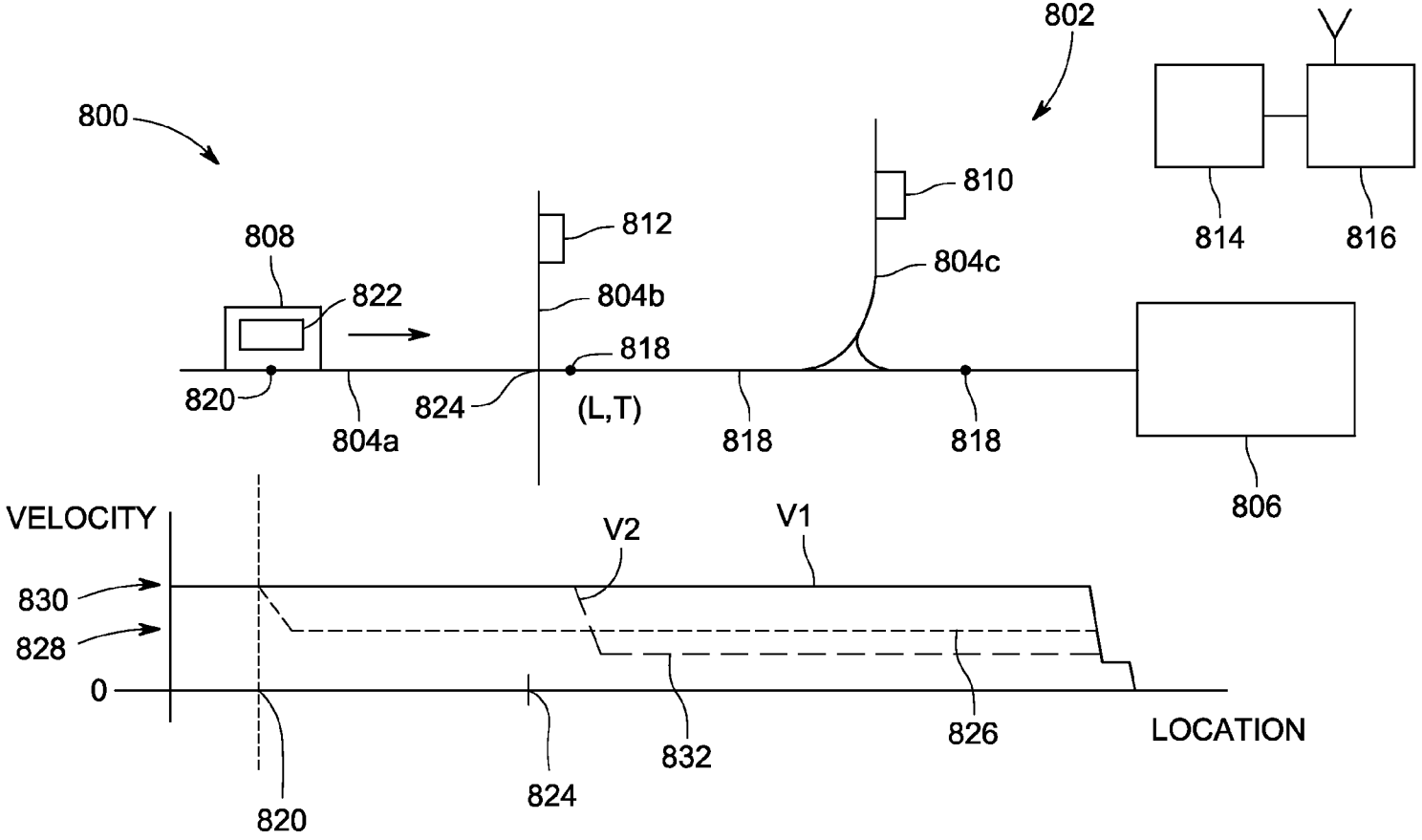
FIG. 8 is a schematic illustration of a system according to embodiments of the inventive subject matter.

FIG. 8 is illustrative of a transportation control system 800 according to several embodiments of the inventive subject matter. The system 800 is implemented in the context of a transportation network 802. As indicated, the transportation network 802 includes one or more routes 804*a*, 804*b*, 804*c*, and a vehicle yard or other designated location 806. A first vehicle system 808 (e.g., first rail vehicle consist) travels along one of routes, as does one or more second vehicle systems 810, 812 (e.g., second rail vehicle consist(s)). The system 800 includes a monitoring module 814 and a scheduling module 816, which is operably connected to the monitoring module. The modules 814, 816 may be located off-board any vehicle systems, such as at a central dispatch office. At least one of the modules includes communication equipment, or an interface with such equipment, for communicating with vehicle systems in the network. The monitoring module 814 is configured to monitor movement of the first vehicle system 808 and at least one second vehicle system 810, 812 in the transportation network. The scheduling module 816 is configured to determine a scheduled time of arrival for the first vehicle system to arrive at the designated location 806, e.g., the scheduled time of arrival may be an updated scheduled time of arrival, such as an updated scheduled time of entry into a vehicle yard.

In one embodiment, the scheduling module 816 is configured to designate one or more scheduled waypoints 818 between a current location 820 of the first vehicle system and the vehicle yard or other designated location 806. The waypoints 818 are designated based on the scheduled time of arrival and the movement of the first and second vehicle systems 808, 810, 812. Each of the one or more scheduled waypoints is defined by a location "L" of the waypoint and a scheduled time of arrival "T" of the first vehicle system at the waypoint. The one or more scheduled waypoints 818 are determined such that movement of the first vehicle system 808 to arrive at the one or more scheduled waypoints as scheduled and arrive at the designated location 806 at the scheduled time of arrival meets one or more criteria in regards to movement of the at least one second vehicle system 810, 812. For example, as noted above, the one or more criteria may comprise movement of the first vehicle system 808 as indicated not affecting the movement of the at least one second vehicle system 810, 812. As another example, the one or more criteria may comprise movement of the first vehicle system as indicated not affecting the movement of the at least one second vehicle system by more than a designated threshold. The scheduling module 816 is configured to communicate the scheduled time of arrival and the one or more scheduled waypoints 818 to the first vehicle system 808 for the first vehicle system to change its speed to meet (i.e., arrive as scheduled at) the scheduled waypoints and updated time of arrival. Thus, it may be the case that at least one of the scheduled waypoints, for the first vehicle system to arrive at the waypoint as scheduled, requires the vehicle system to change speed for arrival at the designated location at the scheduled time of arrival without affecting the travel of one or more other vehicle systems in the network.

In another embodiment of the system 800, the designated location 806 is a vehicle yard, and the monitoring module 814 is configured to track a capacity of the vehicle yard to receive plural vehicle systems for layover in the vehicle yard over time. The vehicle yard is part of the transportation network 802. The scheduling module 816 is configured to determine an updated time of entry for the first vehicle system to enter the vehicle yard (the updated time is an updated scheduled time of entry) based on the capacity of the vehicle yard at the updated time of entry. Scheduled waypoints are designated as described above.

In another embodiment of the system 800, the monitoring module 814 is configured to monitor movement of the first vehicle system 808 and the at least one second vehicle system 810, 812. The scheduling module 816 is configured to determine an updated time of entry for the first vehicle system to enter a vehicle yard of the transportation network, or the scheduling module may otherwise determine a scheduled time of arrival (e.g., updated scheduled time of arrival) for the first vehicle system to arrive at another designated location 806 of the transportation network. The scheduling module 816 is configured to communicate the scheduled time of entry/arrival to the first vehicle system 808 so that the first vehicle system can change speed as the first vehicle system moves toward the vehicle yard or other designated location 806. The scheduling module 816 is configured to select a revised velocity profile "V2" for the first vehicle system, relative to a current velocity profile "V1" of the first vehicle system, that meets one or more criteria relating to the movement of the at least one second vehicle system 810, 812 and for arrival of the first vehicle system at the vehicle yard or other designated location at the scheduled time (e.g., updated scheduled time). Alternatively, in another embodiment, the scheduling module 816 is configured to communicate information of the movement of the at least one second vehicle system 810, 812 to the first vehicle system for a control unit 822 on the first vehicle system to select the revised velocity profile V2. In other embodiments, the scheduling unit or the control unit is configured to select the revised velocity profile for the first vehicle system so that travel of the first vehicle system according to the revised velocity profile would result in less fuel used than travelling according to the current velocity profile.

As an example, suppose the first vehicle system 808 is originally scheduled to arrive at a vehicle yard or other designated location 806 at a first time T1. The first vehicle system 808 travels along a route 804*a* to the vehicle yard 806 according to a trip plan, which establishes a first velocity profile V1 having: a constant velocity to just outside the vehicle yard, a subsequent deceleration, and a final deceleration to stop at the vehicle yard. Traveling according to the trip plan would have the vehicle system clearing a route crossing or intersection 824 at a second time T2, which is before time T1. Later, the scheduling module 816 determines that the vehicle yard will lack sufficient capacity at time T1. The scheduling module 816 identifies the next time T3 (later than T1) when there will be sufficient capacity, or otherwise determines an updated scheduled time for arrival at a designated location. The scheduling module 816 and/or the control unit 822 on board the first vehicle system 808 selects a revised velocity profile V2 (revised relative to the current velocity profile V1) for the first vehicle system 808, based on the updated scheduled time T3 and on movement of the first vehicle system 808 and one or more second vehicle systems 812 in the network. The revised velocity profile V2 is selected to meet one or more criteria relating to the movement of the at least one second vehicle system 810, 812 and for arrival of the first vehicle system at the vehicle yard or other designated location at the updated scheduled time T3. The revised velocity profile V2 may be selected by iteratively analyzing one or more possible/potential second velocity profiles of the first vehicle system for the first vehicle system to arrive at the vehicle yard at the updated scheduled time T3, relative to the vehicle system movement, for determining whether the velocity profile(s) meet the one or more designated criteria. For example, for the first vehicle system starting at a current location 820 and scheduled to arrive at the vehicle yard 806 at a later time than originally scheduled, a first revised velocity profile 826 for analysis might be the first vehicle system 808 decelerating to a lower velocity 828 than its current velocity 830, and traveling at that velocity 828 to the vehicle yard (i.e., over a set route, the simplest control scheme for traveling the same distance over a longer time is a lower constant velocity.) However, traveling at the lower velocity 828 would result in the first vehicle system 808 clearing the crossing or intersection 824 at time T4, which is later than time T2, which is the time the first vehicle system 808 was originally scheduled to cross the crossing or intersection. The scheduling module or control unit determines what effect this would have on the movement of the second vehicle systems 801, 812, if any. For example, if one of the second vehicle systems 812 is scheduled to cross the crossing or intersection 824 around time T4, then the analyzed potential second velocity profile 826 might be deemed as not meeting a designated criterion, as interfering with the second vehicle system 812. That is, in this example, the designated criterion for selecting a velocity profile for use in controlling a vehicle system 808 (to arrive at a vehicle yard at an updated scheduled time) would be that doing so would not interfere with the scheduled or actual travel of any other vehicle systems in the network. If no vehicle systems are scheduled to cross the crossing or intersection 824 around time T4, then the potential second velocity profile 826 is further analyzed by determining whether travel of the first vehicle system 808 along the route 804*a*, as a function of time, would interfere with the scheduled movement of other vehicle systems 810 along the route 804*a*. If not, the potential second velocity profile 826 may be selected for use. If so, then other potential second velocity profiles are analyzed, as a function of movement of the first and second vehicle systems. For example, if the only interaction between a second vehicle system 812 and the route 804*a* between the current time and the updated scheduled time T3 is at time T4 at the crossing or intersection 824, then the scheduling module or control unit may select a second velocity profile based on controlling the first vehicle system temporally (time-wise) around time T4, for example, traveling at the original velocity 830 until past the crossing or intersection 824, and then slowing to a velocity 832, which is less than the original velocity 830, for final travel to the yard to arrive at the updated scheduled time T3. Thus, the scheduling module and/or on-board control unit analyzes each potential second velocity profile for interference with other second, vehicle systems 810, 812 and for meeting other objectives (e.g., reducing fuel use versus other profiles), and selects the one most appropriate according to designated criteria.

In other embodiments, one of the criteria for selecting a revised velocity profile V2 is using less fuel versus controlling the first vehicle system 808 to travel according to the first/original velocity profile V1 or other possible revised velocity profiles. For such determinations, an energy management system on board the first vehicle system 808 may be configured to select the fuel optimal velocity profile that otherwise meets designated criteria (regarding travel of other vehicle systems in the network), or an on-board control unit 822 may be configured to analyze projected fuel usage as a function of vehicle system/engine type, empirical or otherwise determined fuel use versus vehicle system acceleration and velocity curves, or the like.

In other embodiments, in the case when the scheduling system/module determines that the first scheduled time of arrival for a first vehicle system at a designated location is no longer appropriate, the scheduling system/module determines plural second/updated scheduled times, and/or an updated scheduled time window for arrival, any of which are suitable for arrival by the first vehicle system at the designated location. (For example, in the case of a vehicle yard, whereas there might not be capacity at the first scheduled time for the vehicle yard to receive the first vehicle system, there would be such capacity at any of the second/updated scheduled times or updated scheduled time window.) The second/updated scheduled times and/or updated scheduled time window are communicated by the scheduling system/module to the first vehicle system. The control unit on the first vehicle system is configured to select one of the second/updated scheduled times and/or a time within the updated scheduled time window communicated by the scheduling system/module, which serves as the basis for vehicle system control (e.g., as part of a trip plan, selected velocity profile, or the like). The time may be selected based on one or more designated criteria, such as earliest time of arrival, or travelling to arrive at the selected time facilitating lower (or lowest) fuel usage versus other times.

In one embodiment, a system includes a control unit that is configured to be disposed on-board a first vehicle system that moves along a route of a transportation network having a vehicle yard. The control unit also is configured to receive, from off-board the first vehicle system, an updated time of entry into the vehicle yard for the approaching vehicle system and to change a speed of the first vehicle system in response to the updated time of entry.

In another aspect, the first vehicle system is previously scheduled to enter into the vehicle yard at a previous time and the updated time is subsequent to the previous time. The control unit can be configured to decrease the speed of the approaching vehicle system based on the updated time of entry.

In another aspect, the updated time of entry is based on a size of the first vehicle system.

In another aspect, the updated time of entry is based on a capacity of the vehicle yard to receive the first vehicle system at the updated time of entry.

In another aspect, the vehicle yard is interconnected with one or more other routes in a transportation network and the updated time of entry is based on a throughput parameter of vehicle systems traveling through the transportation network.

In another aspect, the updated time of entry is based on travel of one or more other vehicle systems traveling along the route subsequent to the first vehicle system.

In another aspect, the updated time of entry is based on a number of one or more siding route sections or divergent route sections joined with the route between a location of the first vehicle system and the vehicle yard.

In another aspect, the system also includes an energy management system configured to be disposed on-board the first vehicle system. The energy management system also is configured to form a trip plan that dictates tractive efforts of the first vehicle system based on a trip profile and to receive the updated time of entry and revise the trip plan based on the updated time of entry to form a revised trip plan. The control unit is configured to control movement of the first vehicle system based on the revised trip plan.

In another aspect, the control unit is configured to receive the updated time of entry as the first vehicle system is approaching the vehicle yard.

In another aspect, the control unit is further configured to receive from off-board the first vehicle system at least one of (a) one or more scheduled waypoints between a current location of the first vehicle system and the vehicle yard (with each of the one or more scheduled waypoints being defined by a location of the waypoint and a scheduled time of arrival of the first vehicle system at the waypoint) or (b) information of movement of at least one second vehicle system in the transportation network. The control unit can be further configured to at least one of: change the speed of the first vehicle system to meet the one or more scheduled waypoints and to arrive at the vehicle yard at the updated time, or to change the speed of the first vehicle system to meet one or more criteria relating to the movement of the at least one second vehicle system and to arrive at the vehicle yard at the updated time.

In another aspect, the control unit is further configured to select a revised velocity profile for the first vehicle system, relative to a current velocity profile of the first vehicle system, that meets the one or more criteria relating to the movement of the at least one second vehicle system and for arrival of the first vehicle system at the vehicle yard at the updated time, and to change the speed of the first vehicle system according to the revised velocity profile.

In another aspect, the control unit is further configured to select the revised velocity profile for the first vehicle system so that travel of the first vehicle system according to the revised velocity profile would result in less fuel used than travelling according to the current velocity profile.

In another aspect, the one or more criteria comprises travel of the first vehicle system according to the revised velocity profile not affecting the movement of the at least one second vehicle system.

In another embodiment, a method includes receiving an updated time of entry into a vehicle yard at a first vehicle system that is moving along a route of a transportation network that includes the vehicle yard and changing a speed of the first vehicle system in response to the updated time of entry. The updated time is received from off-board the first vehicle system.

In another aspect, the first vehicle system is previously scheduled to enter into the vehicle yard at a previous time and the updated time is subsequent to the previous time. Changing the speed can include decreasing the speed of the first vehicle system based on the updated time of entry.

In another aspect, the updated time of entry is based on a size of the first vehicle system.

In another aspect, the updated time of entry is based on a capacity of the vehicle yard to receive the first vehicle system at the updated time of entry.

In another aspect, the route and the vehicle yard are interconnected in the transportation network and the updated time of entry is based on a throughput parameter of vehicle systems traveling through the transportation network.

In another aspect, the updated time of entry is based on travel of one or more other vehicle systems traveling along the route subsequent to the first vehicle system.

In another aspect, the updated time of entry is based on a number of one or more siding route sections or divergent route sections joined with the route between a location of the first vehicle system and the vehicle yard.

In another aspect, changing the speed comprises providing the updated time of entry to an energy management system disposed on-board the first vehicle system, revising by the energy management system of a trip plan of the first vehicle system based on the updated time of entry to form a revised trip plan, and controlling movement of the first vehicle system based on the revised trip plan.

In another aspect, the method also includes receiving from off-board the first vehicle system one or more scheduled waypoints between a current location of the first vehicle system and the vehicle yard. Each of the one or more scheduled waypoints is defined by a location of the waypoint and a scheduled time of arrival of the first vehicle system at the waypoint. The speed of the first vehicle system is changed to meet the one or more scheduled waypoints and to arrive at the vehicle yard at the updated time.

In another aspect, the method also includes receiving at the first vehicle system information of movement of at least one second vehicle system in the transportation network. The speed of the first vehicle system is changed to meet one or more criteria relating to the movement of the at least one second vehicle system and to arrive at the vehicle yard at the updated time.

In another aspect, the method also includes selecting a revised velocity profile for the first vehicle system, relative to a current velocity profile of the first vehicle system, that meets the one or more criteria relating to the movement of the at least one second vehicle system and for arrival of the first vehicle system at the vehicle yard at the updated time. The speed of the first vehicle system is changed according to the revised velocity profile.

In another aspect, the revised velocity profile for the first vehicle system is selected so that travel of the first vehicle system according to the revised velocity profile would result in less fuel used than travelling according to the current velocity profile.

In another embodiment, another system includes a monitoring module and a scheduling module. The monitoring module is configured to track a capacity of a vehicle yard in a transportation network to receive vehicle systems for layover in the vehicle yard over time. The scheduling module is configured to determine an updated time of entry for a first vehicle system to enter the vehicle yard based on the capacity of the vehicle yard at the updated time of entry. The scheduling module is configured to communicate the updated time of entry to the first vehicle system so that the first vehicle system can change speed as the first vehicle system moves toward the vehicle yard.

In another aspect, the scheduling module is configured to delay a previously scheduled time of entry of the first vehicle system to enter into the vehicle yard to the updated time of entry based on an expected capacity of the vehicle yard to receive the first vehicle system at the updated time of entry.

In another aspect, the scheduling module is configured to receive information of a size of the first vehicle system and to determine the updated time of entry based on the size of the first vehicle system.

In another aspect, the scheduling module is configured to determine the updated time of entry based on a throughput parameter of the transportation network that is representative of a flow of vehicle systems through the transportation network.

In another aspect, the scheduling module is configured to communicate the updated time only if the first vehicle system changing speed to arrive at the vehicle yard at the updated time would not result in the throughput parameter falling below a predetermined threshold.

In another aspect, the scheduling module is configured to determine the updated time of entry based on travel of one or more other, second vehicle systems traveling along a route of the first vehicle system subsequent to the first vehicle system.

In another aspect, the scheduling module is configured to determine the updated time of entry based on a number of one or more siding route sections or divergent route sections joined with a route that the first vehicle system is traveling on toward the vehicle yard between a location of the first vehicle system and the vehicle yard.

In another aspect, the scheduling module is configured to communicate the updated time of entry to an energy management system disposed on-board the first vehicle system and is configured to form a trip plan for controlling the first vehicle system.

In another aspect, the scheduling module is configured to determine the updated time of entry as the first vehicle system is moving toward the vehicle yard.

In another aspect, the scheduling module is configured to receive information of plural other vehicle systems in the transportation network that are traveling to the vehicle yard for layover in the vehicle yard, and to determine the capacity of the vehicle yard at the updated time of entry based on the information of the plural other vehicle systems.

In another aspect, the monitoring module is configured to monitor movement of at least one second vehicle system in the transportation network and the scheduling module is configured to one of (a) select a revised velocity profile for the first vehicle system, relative to a current velocity profile of the first vehicle system, that meets one or more criteria relating to the movement of the at least one second vehicle system and for arrival of the first vehicle system at the vehicle yard at the updated time or (b) communicate information of the movement of the at least one second vehicle system to the first vehicle system for a control unit on the first vehicle system to select the revised velocity profile.

In another aspect, the scheduling module or the control module is configured to select the revised velocity profile for the first vehicle system so that travel of the first vehicle system according to the revised velocity profile would result in less fuel used than travelling according to the current velocity profile.

In another aspect, the scheduling module is configured to generate different sets of schedules for the vehicle systems to travel with at least one of the schedules in the different sets including the updated time of entry. The monitoring module is configured to simulate travel of the vehicle systems according to the different sets of schedules and to calculate throughput parameters associated with the different sets of schedules.

In another aspect, the scheduling module is configured to communicate at least one of the sets of schedules to the vehicle systems based on a comparison between the throughput parameters associated with the different sets of schedules.

In another aspect, the scheduling module is configured to communicate the updated time of entry to the first vehicle system only when a confidence parameter associated with the updated time of entry exceeds a designated threshold. The confidence parameter is representative of a probability that directing the first vehicle system to arrive at the vehicle yard at the updated time of entry will not negatively impact a throughput parameter of the vehicle systems.

In another embodiment, another method includes tracking a capacity of a vehicle yard to receive vehicle systems over time, determining an updated time of entry for a first vehicle system to enter the vehicle yard based on the capacity of the vehicle yard at the updated time of entry, and communicating the updated time of entry to the first vehicle system so that the first vehicle system can change speed as the first vehicle system moves toward the vehicle yard.

In another aspect, determining the updated time of entry includes delaying a previously scheduled time of entry of the first vehicle system to enter into the vehicle yard to the updated time of entry based on an expected capacity of the vehicle yard to receive the first vehicle system at the updated time of entry.

In another aspect, tracking the capacity includes monitoring a size of the first vehicle system and the updated time of entry is based on the size of the first vehicle system.

In another aspect, the first vehicle system travels toward the vehicle yard in a transportation network and the updated time of entry is based on a throughput parameter of the transportation network that is representative of a flow of vehicle systems through the transportation network.

In another aspect, the updated time of entry is based on travel of one or more other vehicle systems traveling along the route subsequent to the first vehicle system.

In another aspect, the updated time of entry is based on a number of one or more siding route sections or divergent route sections joined with a route that the first vehicle system is traveling on toward the vehicle yard between a location of the first vehicle system and the vehicle yard.

In another aspect, communicating the updated time of entry includes transmitting the updated time of entry to an energy management system disposed on-board the first vehicle system for use of the updated time of entry by the energy management system to form a trip plan for controlling the first vehicle system.

In another aspect, determining the updated time of entry and communicating the updated time of entry occur as the first vehicle system is moving toward the vehicle yard.

In another embodiment, another system includes a monitoring module and a scheduling module. The monitoring module is configured to track a capacity of a vehicle yard to receive plural vehicle systems for layover in the vehicle yard over time. The vehicle yard is part of a transportation network having plural routes over which the plural vehicle systems may travel. The monitoring module is further configured to monitor movement of a first vehicle system and at least one second vehicle system of the plural vehicle systems in the transportation network. The scheduling module is configured to determine an updated time of entry for the first vehicle system to enter the vehicle yard based on the capacity of the vehicle yard at the updated time of entry. The scheduling module is further configured to designate one or more scheduled waypoints between a current location of the first vehicle system and the vehicle yard based on the updated time of entry and the movement of the first and second vehicle systems. Each of the one or more scheduled waypoints being defined by a location of the waypoint and a scheduled time of arrival of the first vehicle system at the waypoint. The one or more scheduled waypoints are designated such that movement of the first vehicle system to arrive at the one or more scheduled waypoints as scheduled and enter the vehicle yard at the updated time of entry meets one or more criteria in regards to movement of the at least one second vehicle system. The scheduling module also is configured to communicate the updated time of entry and the one or more scheduled waypoints to the first vehicle system for the first vehicle system to change its speed to meet the scheduled waypoints and updated time of entry.

Figure 9:
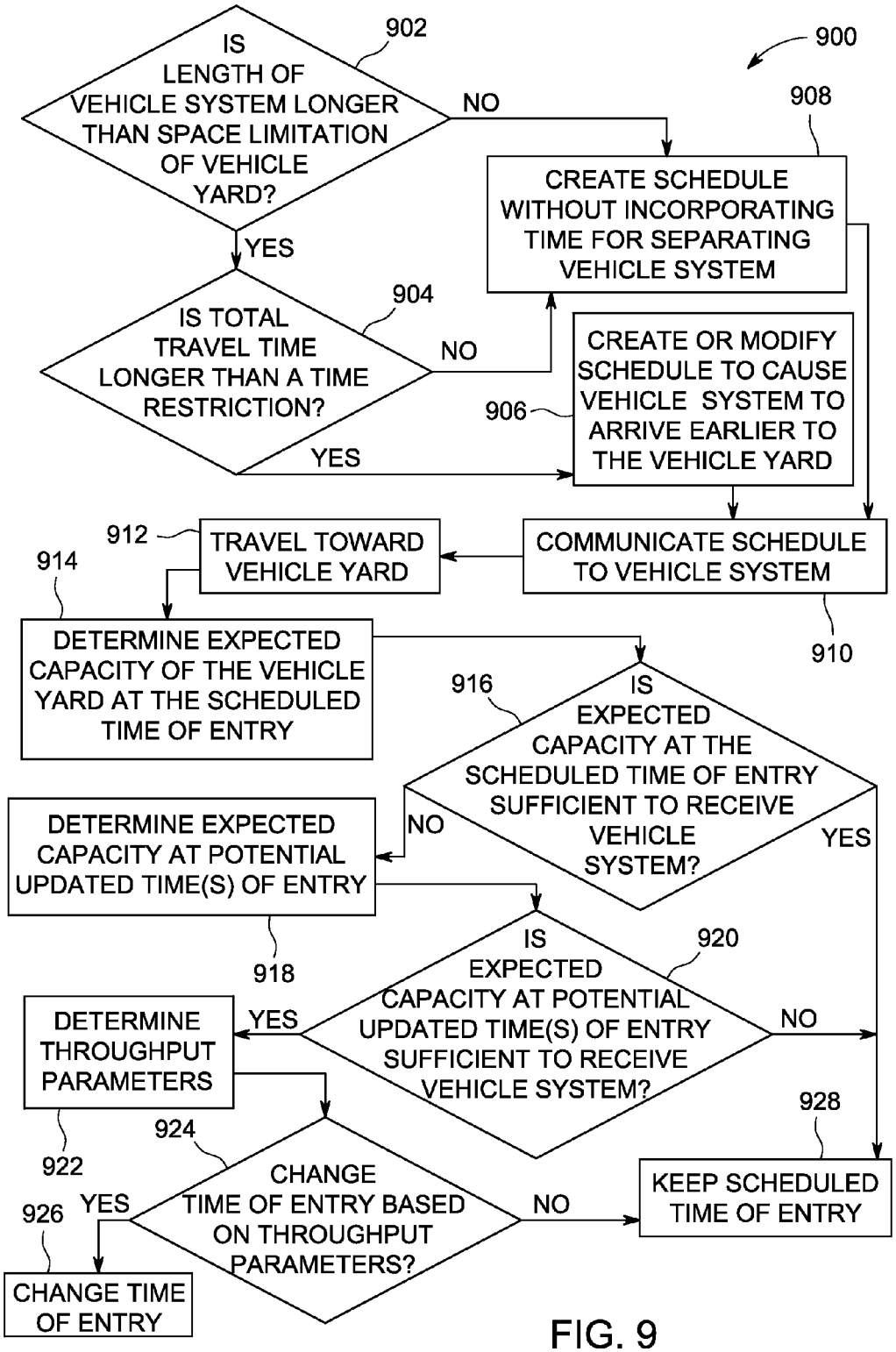
FIG. 9 is a flowchart of another embodiment of a method for scheduling travel of vehicle systems in a transportation network.

Returning to the discussion of the scheduling system 110 shown in FIG. 2, the scheduling module 202 can additionally or alternatively create or modify schedules for the vehicle systems 104 to ensure that the vehicle systems 104 arrive at the vehicle yards 112 with sufficient time to receive the vehicle systems 104 in the vehicle yards 112. One or more of the vehicle systems 104 may be relatively long, such as longer than a space limitation of one or more of the vehicle yards 112. Instead of or in addition to the vehicle systems 104 changing trip plans so that the vehicle systems 104 arrive at a vehicle yard 112 at a time when the vehicle yard 112 is expected to have sufficient capacity to receive the vehicle systems 104 (e.g., to cause the vehicle systems 104 to arrive no earlier than a time when the vehicle yards 112 is estimated to have enough space to receive the vehicle systems 104), the schedules of the vehicle systems 104 may be created or modified so that the total time involved in traveling to the vehicle yards 112 and breaking up the vehicle systems 104 into sizes that can be received in the vehicle FIG. 9 is a flowchart of another embodiment of a method 900 for scheduling travel of vehicle systems in a transportation network. The method 900 may be used to create and/or modify a schedule of a vehicle system 104 (shown in FIG. 1) to control when the vehicle system 104 arrives and/or enters into a vehicle yard 112 (shown in FIG. 1) in order to avoid violating one or more time restrictions on the vehicle systems 104, such as the 12-hour law. In one embodiment, the method 900 may be performed by the scheduling system 110 shown in FIG. 1. Additionally or alternatively, the method 900 may be performed by one or more additional or other components, such as the control system onboard a vehicle system.

At 902, a determination is made as to whether the size of a vehicle system is larger than an upper space limitation of a vehicle yard to which the vehicle system is to travel. For example, a decision may be made as to whether the vehicle system is longer than the longest route in the vehicle yard that can receive the vehicle system. In one embodiment, a monitoring module (as described herein) may compare a length of the vehicle system with an upper space limitation of the vehicle yard. The length of the vehicle system and/or the upper space limitation of the vehicle yard may be input by an operator of the scheduling system 110, received from the vehicle system, and/or obtained from another source, such as a database, list, table, or other memory structure or device.

Figure 10:
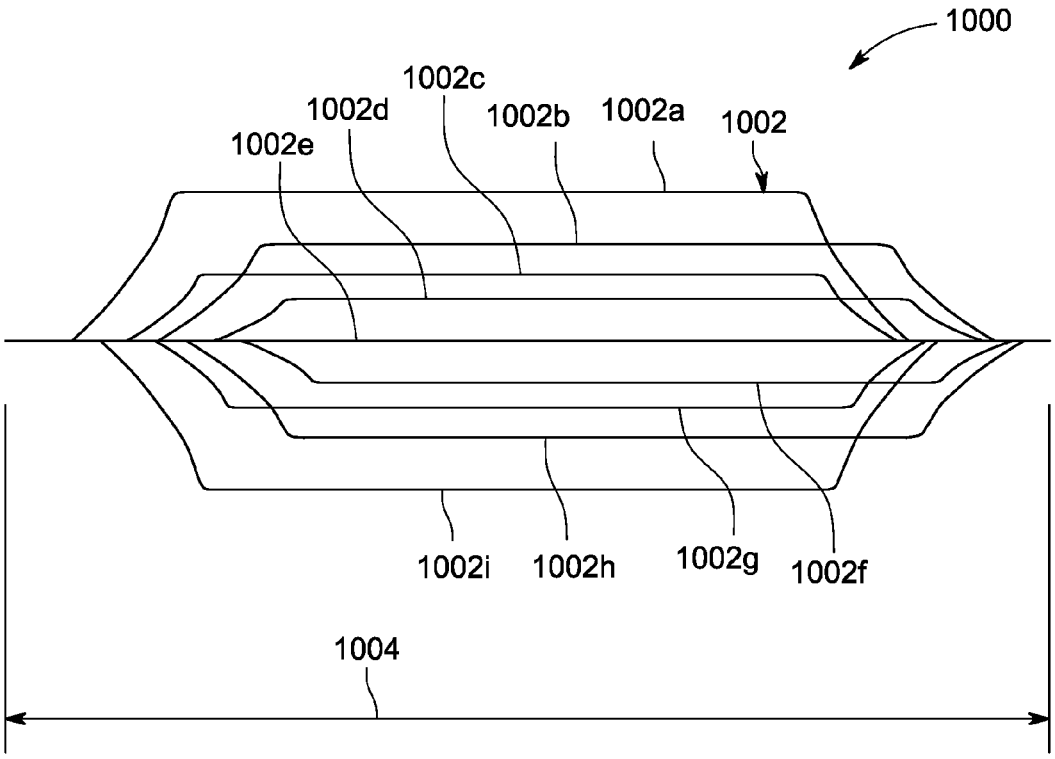
FIG. 10 is a schematic diagram of one embodiment of a vehicle yard.
Figure 11:
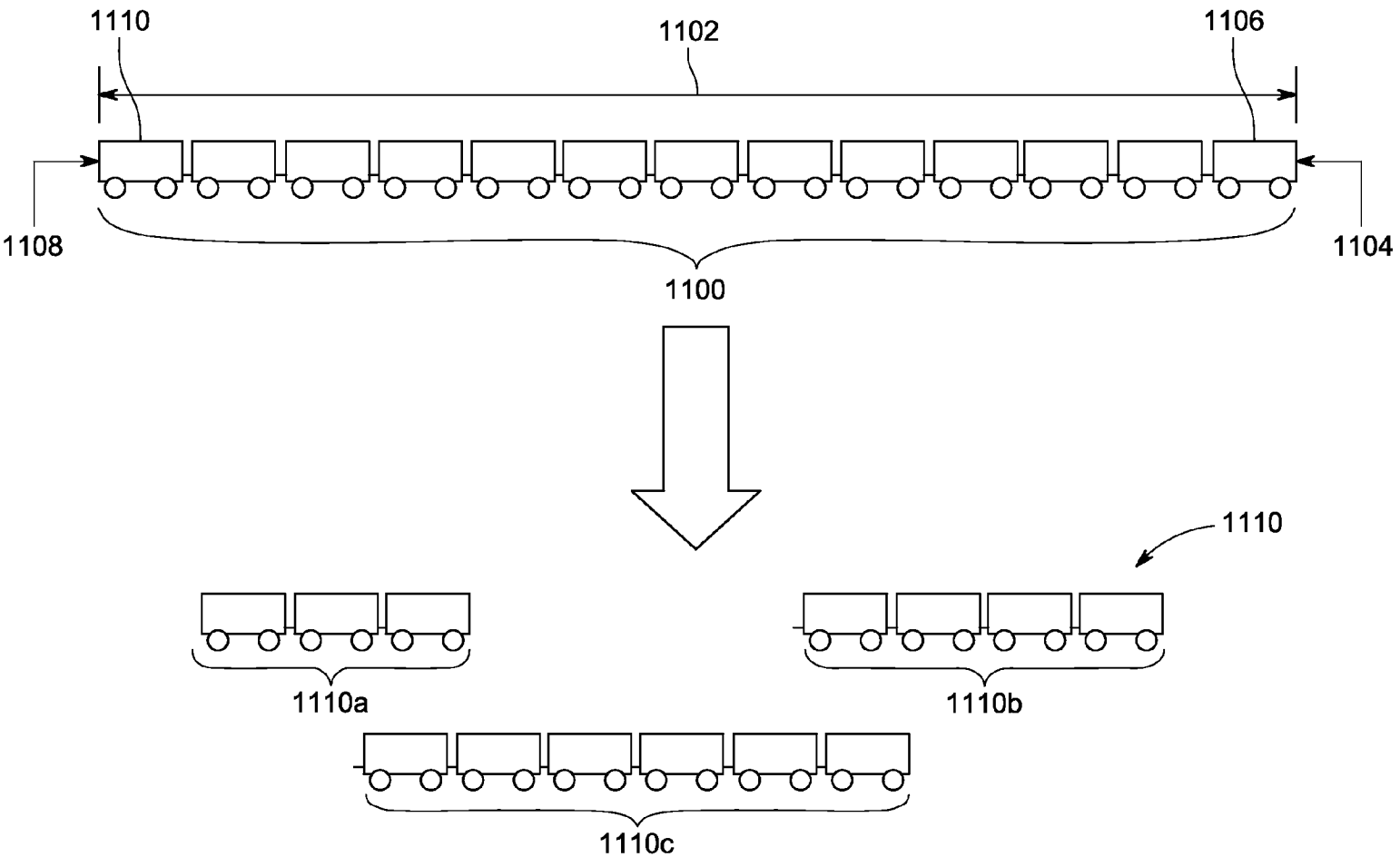
FIG. 11 is a schematic diagram of one embodiment of a vehicle system.

FIG. 10 is a schematic diagram of one embodiment of a vehicle yard 1000. FIG. 11 is a schematic diagram of one embodiment of a vehicle system 1100, such as a vehicle consist. The vehicle yard 1000 may represent one or more of the vehicle yards 112 shown in FIG. 1 and the vehicle system 1100 may represent one or more of the vehicle systems 104 shown in FIG. 1. The vehicle yard 1000 includes several interconnected routes 1002 (e.g., routes 1002*a*-1002*i*). The routes 1002 may be similar to the routes 102 shown in FIG. 1. An upper space limitation 1004 of the vehicle yard 1000 may be defined by the longest continuous route 1002 in the vehicle yard 1000 that can receive vehicle systems. For example, the longest continuous route 1002 that does not branch off of another route 902 is the route 902*e*. The upper space limitation 1004 of the vehicle yard 1000 may be defined by the length of the route 1002*e* in the vehicle yard 1000. The route 1002*e* may be referred to as the receiving route for the vehicle yard 1000.

As shown in FIG. 11, a length 1102 of the vehicle system 1100 is measured between a front end 1104 of a front end vehicle 1106 in the vehicle system 1100 and an opposite back end 1108 of an opposite back end vehicle 1110 in the vehicle system 1100. Therefore, the vehicle system 1100 shown in FIG. 11 is longer than the upper space limitation 1004 of the vehicle yard 1000. As described herein, the vehicle system 1100 may be divided into vehicle subsystems 1110 (e.g., subsystems 1110*a*, 1110*b*, 1110*c*, and the like) so that the vehicle system 1100 can be received into the vehicle yard 1000. The number of vehicle subsystems 1110 may be different from the embodiment shown in FIG. 11. Additionally, the number of vehicles in one or more of the vehicle subsystems 1110 may be different from that shown in FIG. 11. The vehicle subsystems 1110 may include propulsion-generating vehicles and/or non-propulsion generating vehicles. The vehicle subsystems 1110 that do not include a propulsion-generating vehicle may be pulled or pushed into the vehicle yard 1000 using another propulsion-generating vehicle that is not part of the vehicle system 1100. The vehicle subsystems 1110 may be created by separating different subsets or groups of the vehicles in the vehicle system 1100 from each other.

Returning to the discussion of the method 900 shown in FIG. 9, the length 1102 of the vehicle system 1100 can be compared to the upper space limitation 1004 of the vehicle yard 1000. The upper space limitations for the various vehicle yards may be stored or otherwise designated at the scheduling system 110, and the lengths of the vehicle systems may be input into the scheduling system 110. Based on a comparison of the length of a vehicle and the upper space limitation of the vehicle yard to which the vehicle system is traveling, a monitoring module as described herein can determine if the vehicle system is longer than the upper space limitation. If the vehicle system is longer, then additional time may be needed to break up the vehicle system into smaller vehicle subsystems when the vehicle system arrives at the vehicle yard. As a result, flow of the method 900 can proceed to 904. If the vehicle system is no longer than the upper space limitation of the vehicle yard, then additional time may not be needed to break up the vehicle system into smaller vehicle subsystems when the vehicle system arrives at the vehicle yard. As a result, flow of the method 900 can proceed to 908.

At 904, a determination is made as to whether a time for the vehicle system to travel to and enter into the vehicle yard exceeds a time restriction. For example, a total time for the vehicle system to travel from an initial or current location to the vehicle yard, to be broken up from a length that exceeds the upper space limitation of the vehicle yard into two or more separate vehicle subsystems, and to enter the vehicle subsystems into the vehicle yard is determined (e.g., estimated or calculated). The monitoring module (e.g., as described herein) may determine the total time for the vehicle system, the time for the vehicle system to travel to the vehicle yard, the time to break up the vehicle system into vehicle subsystems, and/or to receive the vehicle subsystems into the vehicle yard. The monitoring module may compare the total time to the time restriction to determine if the total time exceeds the time restriction.

The time for the vehicle system to travel to the vehicle yard may be obtained, calculated, or estimated from one or more previous trips to the vehicle yard, from a model of travel of the vehicle system over the route(s) to the vehicle yard, or the like.

The time to break up the vehicle system into the vehicle subsystems and/or to enter the vehicle subsystems into the vehicle yard may be a designated separation time period. For example, a time period of 45 minutes to one hour may be used as the designated time period. The time period to break up the vehicle system may be based on the length of the vehicle system. For example, the time period to break up the vehicle system may be increased for longer vehicle systems and decreased for shorter vehicle systems. The time period to enter the vehicle subsystems into the vehicle yard may be based on the number of vehicle subsystems that will be formed by the breaking up of the vehicle system. For example, the time period to enter the vehicle subsystems into the vehicle yard may be increased for greater number of vehicle subsystems and decreased for smaller numbers of vehicle subsystems.

The time that is determined for the vehicle system to travel to a vehicle yard, be broken up into vehicle subsystems, and entered into the vehicle yard may be referred to as a total travel time. The total travel time can be compared to a time restriction. For example, the total travel time can be compared to the 12-hour limit of the 12-hour law. If the total travel time exceeds the time restriction, then the schedule of the vehicle system may need to be modified to avoid violating (e.g., exceeding) the time restriction. As a result, flow of the method 900 can proceed to 906. On the other hand, if the total travel time does not exceed the time restriction, then the schedule of the vehicle system may not need to be modified to avoid exceeding the time restriction. As a result, flow of the method 900 can proceed to 908.

At 906, the schedule of the vehicle system is modified (or created) such that the vehicle system is less likely to exceed the time restriction. For example, the schedule may be modified so that the vehicle system arrives at the vehicle yard with sufficient time to separate the vehicle system into the vehicle subsystems and enter the vehicle subsystems into the vehicle yard without exceeding the time restriction. In one embodiment, the schedule may be modified or created by a scheduling module as described herein. The schedule can be modified so that the vehicle system arrives at least the designated separation time period ahead of the expiration of the time restriction. For example, the schedule can be modified so that the vehicle system arrives at the vehicle yard at least 45 minutes, at least one hour, or at least another time period before expiration of the time restriction. If an estimated travel time for the vehicle system to travel to the vehicle yard according to a first schedule is twelve hours, if the 12-hour law reflects a time restriction, and the estimated or designated time period for breaking up the vehicle system into vehicle subsystems and entering the subsystems into the vehicle yard is one hour, then this first schedule may be modified into a second schedule by scheduling the vehicle system to arrive at the vehicle yard within no greater than eleven hours. As a result, the vehicle system is scheduled to arrive at the vehicle yard with at least one hour before expiration of the twelve hour time restriction. This additional available time may be used to break up the vehicle system into the vehicle subsystem, and to enter the vehicle subsystems into the vehicle yard, without violating the time restriction.

Modifying or creating the schedule of the vehicle system to avoid violating the time restriction may be completed in one or more ways. As one example, if the vehicle system is capable of traveling to the vehicle yard in the shorter time period, then the scheduled time may be reduced by enough to avoid violating the time restriction. For example, if the vehicle system has sufficient tractive effort and/or power output from the propulsion-generating vehicles of the vehicle system to reach the vehicle system in the reduced period of time, then the schedule may be modified to direct the vehicle system to arrive earlier to allow for time to break up the vehicle system and enter the vehicle subsystems into the vehicle yard.

As another example of modifying or creating the schedule of the vehicle system to avoid violating the time restriction includes changing which routes are taken by the vehicle system to travel to the vehicle yard. The vehicle system may have a variety of combinations of routes than can be used to travel to the vehicle yard. For example, some combinations of routes may be longer than others, some combinations of routes may travel over declined grades more often than others, and the like. A scheduling module (as described herein) may select the combination of routes that causes the vehicle system to arrive at the vehicle yard without violating the time restriction. In one embodiment, the scheduling system 110 may simulate travel of the vehicle system (e.g., a model of the vehicle system) over different combinations of the routes in order to select a combination of the routes that will or is likely to cause the vehicle system to arrive at the vehicle yard without violating the time restriction. Additionally or alternatively, the scheduling system 110 may use previous travels of the vehicle system over the different combinations of the routes in order to select a combination of the routes that will or is likely to cause the vehicle system to arrive at the vehicle yard without violating the time restriction. Additionally or alternatively, the scheduling system 110 may use designated priorities between the different combinations of the routes in order to select a combination of the routes that will or is likely to cause the vehicle system to arrive at the vehicle yard without violating the time restriction.

As another example of modifying or creating the schedule of the vehicle system to avoid violating the time restriction includes changing a vehicle makeup of the vehicle system. A variety of combinations of propulsion-generating vehicles and non-propulsion generating vehicles may be used to create the vehicle system. For example, the number of propulsion-generating vehicles in the vehicle system may be increased and/or the number of non-propulsion generating vehicles in the vehicle system may be decreased to allow the vehicle system to travel faster to the vehicle yard. The makeup of propulsion and/or non-propulsion generating vehicles in the vehicle system can be changed in order to modify a total tractive output (e.g., sum of tractive effort and/or power output provided by the propulsion-generating vehicles in the vehicle system) and/or weight (e.g., mass of cargo carried by the propulsion and/or non-propulsion generating vehicles and/or mass of the vehicles in the vehicle system). Changing the total tractive output and/or weight of the vehicle system can allow the vehicle system to travel faster and arrive earlier to the vehicle yard.

In one embodiment, the scheduling system 110 may simulate travel of the vehicle system (e.g., a model of the vehicle system) using different combinations and/or distributions of the vehicles in the vehicle system in order to select a combination of vehicles that will or is likely to cause the vehicle system to arrive at the vehicle yard without violating the time restriction. Additionally or alternatively, the scheduling system 110 may use previous travels of different combinations of the vehicles in the vehicle system in order to select a combination of vehicles that will or is likely to cause the vehicle system to arrive at the vehicle yard without violating the time restriction.

As another example of modifying or creating the schedule of the vehicle system to avoid violating the time restriction includes changing the schedules of one or more other vehicle systems that also are traveling in the same transportation network. For example, in addition to, or as an alternate to, changing the schedule of a first vehicle system to ensure that the first vehicle system does not violate the time restriction when traveling to a vehicle yard, the schedules of one or more vehicle systems other than the first vehicle system may be modified. These other vehicles may be scheduled to travel within the same transportation network as the first vehicle system, but the schedules of the other vehicles may be changed to allow the first vehicle system to arrive at the vehicle yard, separate into vehicle subsystems, and enter into the vehicle yard without violating the time restriction.

As one example, and with respect to the transportation network 100 shown in FIG. 1, the first vehicle system 104*a* may be scheduled to travel along the routes 102 from the location shown in FIG. 1 to the third vehicle yard 112*c*. Travel of the first vehicle system 104*a* may be restricted (e.g., the speed at which the first vehicle system 104*a* can travel may be reduced) due to the concurrent travel of the second vehicle system 104*b* and/or the third vehicle system 104*c* on the routes 102 between the first vehicle system 104*a* and the third vehicle yard 112*c*. The presence of the second and/or third vehicle systems 104*b*, 104*c* between the first vehicle system 104*a* and the third vehicle yard 112*c* may prevent the first vehicle system 104*a* from traveling faster to the third vehicle yard 112*c* and, as a result, the first vehicle system 104*a* may not be able to travel to the third vehicle yard 112*c* with sufficient time to break up the first vehicle system 104*a* into the vehicle subsystems and enter the vehicle subsystems into the third vehicle yard 112*c* without violating the time restriction.

A scheduling module (e.g., as described herein) may change the schedules of one or more of the other vehicle systems (e.g., the second and/or third vehicle system 104*b*, 104*c*) to allow the first vehicle system 104*a* to arrive earlier at the third vehicle yard 112*c*. For example, the scheduling system 110 may cause the second and/or third vehicle system 104*b*, 104*c* to travel faster, to travel along the routes 102 and out of the way of the first vehicle system 104*a* earlier, to travel on other routes 102 on which the first vehicle system 104*a* is not scheduled to travel, and the like. The schedule of the first vehicle system 104*a* also may be altered so that the first vehicle system 104*a* is scheduled to arrive at the third vehicle yard 112*c* with sufficient time to be broken up into the vehicle subsystems and received in the third vehicle yard 112*c* without violating the time restriction.

Scheduling the vehicle system to arrive earlier to the vehicle yard may involve the vehicle system consuming more fuel and/or generating greater emissions than scheduling the vehicle system to arrive later to the vehicle yard. In one embodiment, a decision of whether to shorten the schedule of the vehicle system to arrive at the vehicle yard earlier may be balanced against the additional cost of fuel and/or increased emissions. For example, arriving at the vehicle yard sufficiently early to enter into the vehicle yard without violating the time restriction may be associated with a cost savings. This cost savings may be reflected in the lower cost of manual labor needed to operate the vehicle system to enter into the vehicle yard without violating the time restriction versus the greater cost of manual labor needed to operate the vehicle system to enter into the vehicle yard after expiration of the time restriction, which can involve increased costs in terms of overtime, paying additional or replacement crew members to operate the vehicle system, and the like. Traveling slower to the vehicle yard (and violating the time restriction), however, also can result in cost savings in terms of fuel savings and/or reduced emissions. In one embodiment, the cost savings of arriving earlier to the vehicle yard (and consuming more fuel and/or generating increased emissions, but avoiding violation of the time restriction) can be compared to the cost savings of arriving later to the vehicle yard (and violating the time restriction, but consuming less fuel and/or generating fewer emissions). If the cost savings of arriving earlier to the vehicle yard exceeds the cost savings of arriving later to the vehicle yard, then the schedule of the vehicle system may be modified. Otherwise, if the cost savings of arriving earlier to the vehicle yard does not exceed the cost savings of arriving later to the vehicle yard, then the schedule of the vehicle system may not be modified.

The changing of the schedule for the vehicle system such that the total travel time of the vehicle system is no greater than a time restriction can result in a movement plan for the transportation network being revised into a modified movement plan. For example, a first movement plan that includes the coordinated schedules of multiple vehicle systems may result in a total travel time of a first vehicle system exceeding a time restriction for traveling to and being received in a vehicle yard. The schedule of the first vehicle system (and/or one or more other vehicle systems) may be modified so that the total travel time of the first vehicle system does not exceed the time restriction. As a result, the movement plan is changed into a modified movement plan that results in the first vehicle system traveling to and being received in the vehicle yard within the time restriction.

Returning to the discussion of the method 900 shown in FIG. 9, at 908, the schedule of the vehicle system that does not need to be modified to allow sufficient time to break up the vehicle system without violating the time restriction is created (e.g., by a scheduling module described herein). For example, because the vehicle system is not longer than the space limitation of the vehicle yard (as determined at 902), the schedule of the vehicle system may not need to be modified as described above. As another example, if the total travel time is sufficiently short that additional time is not needed for breaking up the vehicle system to avoid violating the time restriction (as determined at 904), the schedule of the vehicle system may not need to be modified as described above.

At 910, the schedule is communicated to the vehicle system. The schedule that is communicated may be a schedule that is created or modified to ensure that the vehicle system has sufficient time to be separated into vehicle subsystems and received into the vehicle yard without violating the time restriction. Alternatively, the schedule that is communicated may be a schedule that is not modified in such a manner (e.g., where the vehicle system is not longer than the space limitation of the vehicle yard). Additionally or alternatively, the schedules of one or more other vehicle systems may be communicated to the other vehicle systems. For example, where the schedules of the other vehicle systems are modified to allow a first vehicle system to arrive at a vehicle yard sufficiently early to avoid violating a time restriction, the schedules of the other vehicle systems may be communicated to the other vehicle systems.

In one embodiment, the vehicle systems may travel according to the revised or modified movement plan described above. Additionally or alternatively, the schedules of the vehicle systems may continue to be examined as the vehicle systems travel in the transportation network, similar to as described above in connection with the method 700 shown in FIG. 7. A discussion of such an embodiment follows.

For example, at 912, the vehicle system travels toward the vehicle yard. For example, the vehicle system may travel along one or more routes in the transportation network toward the vehicle yard in which the vehicle system will be received.

At 914, a time of entry that is scheduled for the vehicle system is determined. For example, similar to 702 of FIG. 7, the time of entry for the vehicle system to arrive at and/or be received into the vehicle yard is determined from the schedule of the vehicle system.

At 916, an expected capacity of the vehicle yard to receive the vehicle system at the scheduled time of entry is determined. As described above in connection with 704 in the method 700 of FIG. 7, the expected capacity of the vehicle yard may be estimated or calculated at the scheduled time of entry of the vehicle system.

At 918, a determination is made as to whether the expected capacity of the vehicle yard at the scheduled time of entry is sufficient for the vehicle yard to receive the vehicle system at the scheduled time of entry. For example, similar to described above in connection with 706 in the method 700 shown in FIG. 7, the expected capacity of the vehicle yard may be compared to the length of the vehicle system. Although the schedule of the vehicle system may have been created and/or modified in order to account for the additional time needed to separate the vehicle system into vehicle subsystems and receive the subsystems into the vehicle yard without violating a time restriction, the actual capacity of the vehicle yard may change while the vehicle system in en route to the vehicle yard. In order to avoid a scenario where the vehicle system arrives at the vehicle yard at the scheduled time but with the vehicle yard having insufficient space to receive the vehicle system (even with breaking up the vehicle system into vehicle subsystems), the expected capacity of the vehicle yard may be determined.

If the expected capacity is sufficiently large to receive the vehicle system at the scheduled time of entry (e.g., with or without breaking up the vehicle system into vehicle subsystems), then the scheduled time of entry may not need to be changed. For example, the time of entry for the vehicle system may not need to be changed because the vehicle yard will be able to accept the vehicle system, such as with or without breaking up the vehicle system into multiple vehicle subsystems. As a result, flow of the method 900 may proceed to 928.

On the other hand, if the expected capacity is not large enough to receive the vehicle system, then the time of entry may need to be changed (e.g., advanced or delayed) to avoid the vehicle system traveling to a location outside of the vehicle yard and waiting (e.g., stopping and idling) outside of the vehicle yard for the vehicle yard to have sufficient capacity to receive the vehicle system (e.g., the entire continuous vehicle system without breaking up the vehicle system into vehicle subsystems or with the vehicle system broken up into the vehicle subsystems). As a result, the flow of the method 900 flows to 918.

At 918, the expected capacity of the vehicle yard is determined for one or more potential updated times of entry. For example, the expected capacities of the vehicle yard can be calculated at times other than the previously scheduled time of entry, similar to as described above in connection with 710 of the method 700 shown in FIG. 7.

At 920, a determination is made as to whether the expected capacity of the vehicle yard at one or more of the potential updated times of entry is sufficient for the vehicle yard to receive the vehicle system at the potential updated times of entry. If the expected capacity is sufficiently large to receive the entire vehicle system (e.g., without being separated into vehicle subsystems or with being separated into the vehicle subsystems) at one or more of the potential updated times of entry, then the previously scheduled time of entry may be changed to the one or more of the potential updated times of entry. For example, the time of entry for the vehicle system may be delayed to a later time so that the vehicle yard will have space to receive the vehicle system when the vehicle system arrives at the vehicle yard. As a result, flow of the method 900 may proceed to 922.

On the other hand, if the expected capacity is not large enough to receive the vehicle system at the potential updated times of entry, then the previously scheduled time of entry may not be changed (e.g., advanced or delayed). For example, the expected capacities of the vehicle yard may be so low at the potential updated times of entry that changing the previously scheduled time of entry may be unsuccessful in getting the vehicle system to the vehicle yard in time when the vehicle yard has space for the vehicle system. As a result, flow of the method 900 proceeds to 928.

At 922, one or more throughput parameters of the transportation network are calculated at the potential updated times. For example, estimated throughput parameters may be calculated for the transportation network at the potential updated times of entry that the vehicle yard may have sufficient capacity to receive the vehicle system, similar to as described above in connection with 714 in the method 700 shown in FIG. 7. In one embodiment, if a potential updated time would cause the vehicle system to arrive too late to the vehicle yard to allow the vehicle system to be broken up into the vehicle subsystems (e.g., without violating the time restriction), then the potential updated time may be disregarded (e.g., discarded).

At 924, the one or more throughput parameters associated with the potential updated times of entry at which the vehicle yard has sufficient capacity are examined to determine if any of the throughput parameters are large enough to change the time of entry. For example, similar to 716 of the method 700 shown in FIG. 7, the throughput parameters may be compared to one or more thresholds and/or each other to determine if a threshold parameter is sufficiently large. If one or more of the throughput parameters exceed the thresholds and/or are otherwise sufficiently large, then the previously scheduled time of entry may be changed to the updated time of entry associated with one or more of the throughput parameters without significantly decreasing the flow of travel in the transportation network. As a result, flow of the method 900 can proceed to 926.

On the other hand, if the throughput parameters are not sufficiently large (e.g., do not exceed one or more thresholds), then the previously scheduled time of entry may not be able to be changed to the corresponding updated times of entry without negatively impacting the flow of traffic in the transportation network. For example, delaying the time of entry may cause the travel of other vehicle systems in the transportation network to be impeded or otherwise interfered with. If the throughput parameters are not sufficiently large, then flow of the method 900 may proceed to 928.

At 926, the previously scheduled time of entry associated with the throughput parameter and an expected capacity of the vehicle yard that are sufficiently large is changed to the corresponding updated time of entry. As described above, the updated time of entry can be communicated to the vehicle system and the control system of the vehicle system may change the speed of the vehicle system based on the updated time of entry. For example, the energy management module may calculate a trip plan or modify a previously created trip plan for the vehicle system to arrive at the vehicle yard at the updated time of entry. The vehicle system may then arrive at the vehicle yard and be broken up into vehicle subsystems that are received within the vehicle yard. The changing of the schedule for the vehicle system such that the total travel time of the vehicle system is no greater than a time restriction can result in a movement plan for the transportation network being revised into a modified movement plan.

At 928, the previously scheduled time of entry for the vehicle system is not changed. For example, if the vehicle yard is expected to have sufficient capacity to receive the vehicle system at the previously scheduled time of entry, the vehicle yard will not have sufficient capacity at the potential updated times of entry, the throughput parameters associated with the potential updated times of entry are too low, and/or there are no potential updated times in which the vehicle system can travel to the vehicle yard, be broken up into the vehicle subsystems, and received into the vehicle yard, then the time of entry for the vehicle system may not be changed. As a result, the vehicle system may continue to travel to the vehicle yard in order to arrive at the previously scheduled time of entry.

In one embodiment, a method (e.g., for scheduling and/or controlling travel of a vehicle system in a transportation network) includes, responsive to a determination that a first vehicle system to be received in a vehicle yard is longer than a length of a receiving route of the vehicle yard that is designated for receiving the first vehicle system, processing a first movement plan to generate a revised movement plan. The first movement plan governs movement of the first vehicle system and one or more second vehicle systems in a transportation network that includes the vehicle yard. The revised movement plan is generated based at least in part on a designated time restriction for the first vehicle system to travel to and be received within the vehicle yard on the receiving route. The method also includes controlling at least one of the first vehicle system or at least one of the one or more second vehicle systems based on the revised movement plan.

In another aspect, the method includes determining a first time period for the first vehicle system to travel to the vehicle yard, determining a second time period for the first vehicle system to be broken up into two or more separate vehicle subsystems and for the two or more separate vehicle subsystems to be received into the vehicle yard, and changing a schedule of at least one of the first vehicle system or the one or more second vehicle systems to reduce the first time period for the first vehicle system to travel to the vehicle yard when a sum of the first time period and the second time period exceeds the designated time restriction.

In another aspect, the time restriction is a designated limitation on how long a first crew of one or more operators of the first vehicle system are allowed to operate the first vehicle system before being replaced by a different, second crew of one or more different operators. The designated limitation can be at least one of a legal or regulatory limitation.

In another aspect, processing the first movement plan includes changing a schedule of the first vehicle system in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, processing the first movement plan includes changing a schedule of one or more of the second vehicle systems in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, processing the first movement plan includes changing which routes of the transportation network that are traveled by the first vehicle system to reach the vehicle yard in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, the first vehicle system includes a combination of one or more propulsion-generating vehicles and one or more non-propulsion generating vehicles interconnected with each other. Processing the first movement plan can include changing the combination of at least one of the one or more propulsion-generating vehicles or the one or more non-propulsion generating vehicles of the first vehicle system to cause the first vehicle system to arrive at least a designated time period early to the vehicle yard relative to the first movement plan such that the first vehicle system is separated into two or more vehicle subsystems that are received into the vehicle yard within the time restriction.

In another aspect, the at least one of the first vehicle system or at least one of the one or more second vehicle systems are autonomously controlled according to the revised movement plan.

In another aspect, controlling the at least one of the first vehicle system or at least one of the one or more second vehicle systems includes directing a human operator to manually control the at least one of the first vehicle system or at least one of the one or more second vehicle systems according to the revised movement plan.

In one embodiment, a system (e.g., a scheduling system) includes a monitoring module and a scheduling module. The monitoring module is configured to determine when a length of a first vehicle system is longer than a length of a receiving route of the vehicle yard that is designated for receiving the first vehicle system. The scheduling module is configured to process a first movement plan to generate a revised movement plan in response to the monitoring module determining that the length of the first vehicle system is longer than the length of the receiving route. The first movement plan governs movement of the first vehicle system and one or more second vehicle systems in a transportation network that includes the vehicle yard. The scheduling module is configured to generate the revised movement plan based at least in part on a designated time restriction for the first vehicle system to travel to and be received within the vehicle yard on the receiving route.

In another aspect, the scheduling module is configured to create the revised movement plan for communication of at least a first schedule of the revised movement plan to the first vehicle system by a communication unit. The first schedule is used by the first vehicle system to travel to and be received in the vehicle yard.

In another aspect, the monitoring module is configured to determine a first time period for the first vehicle system to travel to the vehicle yard and a second time period for the first vehicle system to be broken up into two or more separate vehicle subsystems and for the two or more separate vehicle subsystems to be received into the vehicle yard. The scheduling module is configured to change a schedule of at least one of the first vehicle system or the one or more second vehicle systems to reduce the first time period for the first vehicle system to travel to the vehicle yard when a sum of the first time period and the second time period exceeds the designated time restriction.

In another aspect, the time restriction is a designated limitation on how long a first crew of one or more operators of the first vehicle system are allowed to operate the first vehicle system before being replaced by a different, second crew of one or more different operators. The designated limitation can be at least one of a legal or regulatory limitation.

In another aspect, the scheduling module is configured to change a schedule of the first vehicle system in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, the scheduling module is configured to change a schedule of one or more of the second vehicle systems in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, the scheduling module is configured to change which routes of the transportation network that are traveled by the first vehicle system to reach the vehicle yard in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

In another aspect, the first vehicle system includes a combination of one or more propulsion-generating vehicles and one or more non-propulsion generating vehicles interconnected with each other. The scheduling module can be configured to direct a change in the combination of at least one of the one or more propulsion-generating vehicles or the one or more non-propulsion generating vehicles of the first vehicle system to cause the first vehicle system to arrive at least a designated time period early to the vehicle yard relative to the first movement plan such that the first vehicle system is separated into two or more vehicle subsystems that are received into the vehicle yard within the time restriction.

In one embodiment, a method (e.g., for scheduling and/or controlling travel of a vehicle system) includes determining if a length of the vehicle system that includes one or more vehicles interconnected with each other exceeds a space limitation of a vehicle yard that is scheduled to receive the vehicle system and calculating a travel time for the vehicle system to travel from at least one of a current or initial location to the vehicle yard, for the vehicle system to be separated into plural separate vehicle subsystems, and for the separate vehicle subsystems to be received into the vehicle yard. The method also includes, responsive to determining when the travel time exceeds a designated working time restriction on how long one or more operators of the vehicle system can work on the vehicle system before being replaced by one or more other operators, modifying a schedule of the vehicle system such that the vehicle system arrives at the vehicle yard at least a designated time period before expiration of the designated working time restriction after the vehicle system begins traveling toward the vehicle yard.

In another aspect, the designated time period represents a time period for separating the vehicle system into the separate vehicle subsystems and entering the separate vehicle subsystems into the vehicle yard.

In another aspect, modifying the schedule of the vehicle system includes at least one of directing the vehicle system to travel faster toward the vehicle system, directing the vehicle system to travel over one or more different routes than a previous schedule of the vehicle system to travel to the vehicle yard, or directing one or more other vehicle systems to travel over one or more different routes than one or more other previous schedules of the one or more other vehicle systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §108, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "comprises," "including," "includes,"

"having," or "has" an element or a plurality of elements having a particular property may include additional such elements not having that property.

What is claimed is:

1. A method comprising:

responsive to a determination that a first vehicle system to be received in a vehicle yard is longer than a length of a receiving route of the vehicle yard that is designated for receiving the first vehicle system, processing, using one or more processors, a first movement plan to generate a revised movement plan, wherein the first movement plan governs movement of the first vehicle system and one or more second vehicle systems in a transportation network that includes the vehicle yard, and wherein the revised movement plan is generated based at least in part on a designated time restriction for the first vehicle system to travel to and be received within the vehicle yard on the receiving route; and controlling, using the one or more processors, at least one of the first vehicle system or at least one of the one or more second vehicle systems based on the revised movement plan such that the first vehicle system arrives at the vehicle yard and is received on the receiving route before expiration of the designated time restriction.

2. The method of claim 1, further comprising:

determining, using the one or more processors, a first time period for the first vehicle system to travel to the vehicle yard;

determining, using the one or more processors, a second time period for the first vehicle system to be broken up into two or more separate vehicle subsystems and for the two or more separate vehicle subsystems to be received into the vehicle yard; and changing, using the one or more processors, a schedule of at least one of the first vehicle system or the one or more second vehicle systems to reduce the first time period for the first vehicle system to travel to the vehicle yard when a sum of the first time period and the second time period exceeds the designated time restriction.

3. The method of claim 1, wherein the time restriction is a designated limitation on how long a first crew of one or more operators of the first vehicle system are allowed to operate the first vehicle system before being replaced by a different, second crew of one or more different operators.

4. The method of claim 1, wherein processing the first movement plan includes changing a schedule of the first vehicle system in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

5. The method of claim 1, wherein processing the first movement plan includes changing a schedule of one or more of the second vehicle systems in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

6. The method of claim 1, wherein processing the first movement plan includes changing which routes of the transportation network that are traveled by the first vehicle system to reach the vehicle yard in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

7. The method of claim 1, wherein the first vehicle system includes a combination of one or more propulsion-generating vehicles and one or more non-propulsion generating vehicles interconnected with each other, and wherein processing the first movement plan includes changing the combination of at least one of the one or more propulsion-generating vehicles or the one or more non-propulsion generating vehicles of the first vehicle system to cause the first vehicle system to arrive at least a designated time period early to the vehicle yard relative to the first movement plan such that the first vehicle system is separated into two or more vehicle subsystems that are received into the vehicle yard within the time restriction.

8. The method of claim 1, wherein the at least one of the first vehicle system or at least one of the one or more second vehicle systems are autonomously controlled according to the revised movement plan.

9. The method of claim 1, wherein controlling the at least one of the first vehicle system or at least one of the one or more second vehicle systems includes directing a human operator to manually control the at least one of the first vehicle system or at least one of the one or more second vehicle systems according to the revised movement plan.

10. A system comprising:

one or more processors configured to determine when a length of a first vehicle system is longer than a length of a receiving route of the vehicle yard that is designated for receiving the first vehicle system;

wherein the one or more processors also are configured to process a first movement plan to generate a revised movement plan in response to the one or more processors determining that the length of the first vehicle system is longer than the length of the receiving route, wherein the first movement plan governs movement of the first vehicle system and one or more second vehicle systems in a transportation network that includes the vehicle yard, and wherein the one or more processors are configured to generate the revised movement plan based at least in part on a designated time restriction for the first vehicle system to travel to and be received within the vehicle yard on the receiving route such that the first vehicle system being controlled according to the revised movement plan arrives at the vehicle yard and is received on the receiving route before expiration of the designated time restriction.

11. The system of claim 10, wherein the one or more processors are configured to create the revised movement plan for communication of at least a first schedule of the revised movement plan to the first vehicle system by a communication unit, wherein the first schedule is used by the first vehicle system to travel to and be received in the vehicle yard.

12. The system of claim 10, wherein the one or more processors are configured to determine a first time period for the first vehicle system to travel to the vehicle yard and a second time period for the first vehicle system to be broken up into two or more separate vehicle subsystems and for the two or more separate vehicle subsystems to be received into the vehicle yard, and wherein the one or more processors are configured to change a schedule of at least one of the first vehicle system or the one or more second vehicle systems to reduce the first time period for the first vehicle system to travel to the vehicle yard when a sum of the first time period and the second time period exceeds the designated time restriction.

13. The system of claim 10, wherein the time restriction is a designated limitation on how long a first crew of one or more operators of the first vehicle system are allowed to operate the first vehicle system before being replaced by a different, second crew of one or more different operators.

14. The system of claim 10, wherein the one or more processors are configured to change a schedule of the first vehicle system in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

15. The system of claim 10, wherein the one or more processors are configured to change a schedule of one or more of the second vehicle systems in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

16. The system of claim 10, wherein the one or more processors are configured to change which routes of the transportation network that are traveled by the first vehicle system to reach the vehicle yard in the revised movement plan to cause the first vehicle system to arrive at least a designated time period early to the vehicle yard relative to the first movement plan such that the first vehicle system is separated into two or more vehicle subsystems that are received into the vehicle yard within the time restriction.

17. The system of claim 10, wherein the first vehicle system includes a combination of one or more propulsion-generating vehicles and one or more non-propulsion generating vehicles interconnected with each other, and wherein the one or more processors are configured to direct a change in the combination of at least one of the one or more propulsion-generating vehicles or the one or more non-propulsion generating vehicles of the first vehicle system to cause the first vehicle system to arrive at least a designated time period early to the vehicle yard relative to the first movement plan such that the first vehicle system is separated into two or more vehicle subsystems that are received into the vehicle yard within the time restriction.

18. A method comprising:

determining, using one or more processors, if a length of a vehicle system that includes one or more vehicles interconnected with each other exceeds a space limitation of a vehicle yard that is scheduled to receive the vehicle system;

calculating, using the one or more processors, a travel time for the vehicle system to travel from at least one of a current location or an initial location to the vehicle yard, for the vehicle system to be separated into plural separate vehicle subsystems, and for the separate vehicle subsystems to be received into the vehicle yard; and responsive to determining when the travel time exceeds a designated working time restriction on how long one or more operators of the vehicle system can work on the vehicle system before being replaced by one or more other operators, modifying, using the one or more processors, a schedule of the vehicle system such that the vehicle system arrives at the vehicle yard at least a designated time period before expiration of the designated working time restriction after the vehicle system begins traveling toward the vehicle yard.

19. The method of claim 18, wherein the designated time period represents a time period for separating the vehicle system into the separate vehicle subsystems and entering the separate vehicle subsystems into the vehicle yard.

20. The method of claim 18, wherein modifying the schedule of the vehicle system includes at least one of directing the vehicle system to travel faster toward the vehicle system, directing the vehicle system to travel over one or more different routes than a previous schedule of the vehicle system to travel to the vehicle yard, or directing one or more other vehicle systems to travel over one or more different routes than one or more other previous schedules of the one or more other vehicle systems.

* * * * *